US008066075B2

(12) United States Patent
Cowie et al.

(10) Patent No.: US 8,066,075 B2
(45) Date of Patent: Nov. 29, 2011

(54) COMPLETION SUSPENSION VALVE SYSTEM

(75) Inventors: Gavin David Cowie, Kincardineshire (GB); Jeffrey Charles Edwards, Aberdeen (GB)

(73) Assignee: Enovate Systems Limited, Aberdeen (GB)

( * ) Notice: Subject to any disclaimer, the term of this patent is extended or adjusted under 35 U.S.C. 154(b) by 1129 days.

(21) Appl. No.: 10/587,329

(22) PCT Filed: Jan. 21, 2005

(86) PCT No.: PCT/GB2005/000209

§ 371 (c)(1),
(2), (4) Date: Apr. 25, 2007

(87) PCT Pub. No.: WO2005/071221

PCT Pub. Date: Aug. 4, 2005

(65) Prior Publication Data

US 2007/0204999 A1 Sep. 6, 2007

(30) Foreign Application Priority Data

Jan. 23, 2004 (GB) ..... 0401440.3

(51) Int. Cl.
*E21B 34/06* (2006.01)

(52) U.S. Cl. ..... 166/344; 166/339; 166/373; 166/386; 166/332.3; 251/315.01; 251/315.16; 251/62

(58) Field of Classification Search ..... 166/344, 166/338, 339, 368, 373, 381, 316, 332.2, 166/332.3; 251/315.01–315.16, 62
See application file for complete search history.

(56) References Cited

U.S. PATENT DOCUMENTS

| | | | | | |
|---|---|---|---|---|---|
| 2,722,397 | A | * | 11/1955 | Bruce et al. | 251/110 |
| 3,298,286 | A | * | 1/1967 | Tyler | 92/140 |
| 3,386,461 | A | * | 6/1968 | Fisher | 137/237 |
| 3,552,440 | A | * | 1/1971 | Smith | 137/625.47 |
| 3,672,262 | A | * | 6/1972 | Karr | 92/140 |
| 3,747,618 | A | * | 7/1973 | Boes | 137/80 |
| 3,762,682 | A | * | 10/1973 | Franck | 251/124 |
| 3,980,135 | A | * | 9/1976 | Garrett | 166/322 |
| 4,256,283 | A | * | 3/1981 | Reneau et al. | 251/62 |
| 4,338,857 | A | * | 7/1982 | Mason | 92/62 |
| 4,519,576 | A | * | 5/1985 | Winegeart | 251/62 |
| 4,576,358 | A | * | 3/1986 | Mott et al. | 251/14 |
| 4,582,140 | A | * | 4/1986 | Barrington | 166/334.2 |
| 4,632,187 | A | * | 12/1986 | Deaton | 166/323 |

(Continued)

FOREIGN PATENT DOCUMENTS

GB 1 419 850 12/1975

(Continued)

*Primary Examiner* — Thomas Beach
*Assistant Examiner* — Matthew Buck
(74) *Attorney, Agent, or Firm* — Tarolli, Sundheim, Covell & Tummino LLP

(57) ABSTRACT

A completion suspension valve system is described which allows a well to be suspended and desuspended remotely without a dual bore riser to the surface. This is achieved by incorporating a remotely actuatable valve into the production bore of a tubing hanger. The valve is hydraulically operable and may be controlled via the tubing hanger running tool or via the xmas tree. The valve can be closed and tested after the tubing hanger has been installed, thereby isolating the well. The dual bore riser and running tool are retrievable and the MODU type vessel is then free to continue drilling and completion operations elsewhere. The xmas tree can therefore be deployed from a workclass supply boat instead of a MODU type vessel.

22 Claims, 38 Drawing Sheets

U.S. PATENT DOCUMENTS 5,324,008 A * 6/1994 Bonetti ..... 251/315.16
5,535,826 A * 7/1996 Brown et al. ..... 166/363
5,542,643 A * 8/1996 Breth ..... 251/62
5,782,304 A * 7/1998 Garcia-Soule et al. ..... 166/356
5,873,415 A * 2/1999 Edwards ..... 166/344
5,884,703 A * 3/1999 Garcia-Soule et al. ..... 166/356
5,884,706 A * 3/1999 Edwards ..... 166/335
5,884,707 A * 3/1999 Garcia-Soule et al. ..... 166/356
5,884,708 A * 3/1999 Garcia-Soule et al. ..... 166/356
5,894,890 A * 4/1999 Garcia-Soule et al. ..... 166/356
5,971,077 A * 10/1999 Lilley ..... 166/368
5,992,527 A * 11/1999 Garnham et al. ..... 166/379
6,086,038 A * 7/2000 Ma ..... 251/58
6,109,353 A * 8/2000 Edwards et al. ..... 166/367
6,170,578 B1 * 1/2001 Edwards et al. ..... 166/339
6,186,237 B1 * 2/2001 Voss et al. ..... 166/337
6,328,109 B1 * 12/2001 Pringle et al. ..... 166/373
6,357,529 B1 * 3/2002 Kent et al. ..... 166/344
6,508,309 B1 * 1/2003 French ..... 166/323
6,640,688 B1 * 11/2003 Harper ..... 92/23
6,679,330 B1 * 1/2004 Compton et al. ..... 166/348
6,708,946 B1 * 3/2004 Edwards et al. ..... 251/58
6,729,392 B2 * 5/2004 DeBerry et al. ..... 166/75.14
7,434,625 B2 * 10/2008 Adams ..... 166/373
2001/0007284 A1 * 7/2001 French et al. ..... 166/373
2002/0007950 A1 * 1/2002 Simpson et al. ..... 166/332.2
2002/0153143 A1 * 10/2002 Compton et al. ..... 166/368

FOREIGN PATENT DOCUMENTS

WO WO 00/047864 A1 8/2000
WO WO 03/067017 A2 8/2003

* cited by examiner

COMPLETION SUSPENSION VALVE SYSTEM

FIELD OF THE INVENTION

The present invention relates to subsea well installations and particularly, but not exclusively, to well installations and a completion suspension valve system that facilitates the economic suspension and desuspension of a well.

BACKGROUND OF THE INVENTION

A typical subsea wellhead assembly has a high pressure wellhead housing supported in a lower pressure wellhead housing and secured to casing that extends into the well. One or more casing hangers land, i.e. are supported by the wellhead housing, and the casing hangers being located at the upper end of a string of casing that extends into the well to a deeper depth. A string of tubing extends through the casing for production fluids. A xmas or production tree is mounted to the upper end of the wellhead housing for controlling the well fluid. The production tree is typically a large, heavy assembly, having a number of valves and controls mounted thereon for controlling the passage of well fluid through the production tree.

One type of production tree, sometimes known as a "conventional tree" has two bores, one of which is a production bore and the other bore is the tubing annulus access bore. In this type of wellhead assembly, the tubing hanger is supported by the wellhead housing and the tubing hanger has two passages through it; one passage being the production passage and the other passage being an annulus passage which communicates with the tubing annulus surrounding the tubing. Access to the tubing annulus is necessary to circulate fluids down the production tubing and up through the tubing annulus or vice versa to either kill the well or circulate heavy fluid during completion. After the tubing hanger is installed and before the drilling riser is removed for installation of the tree, the downhole safety valve is closed and plugs are temporarily placed in the passages of tubing hanger; this is known as well suspension.

The conventional tree has isolation tubes that stab into engagement with passages in the tubing hanger when the tree lands in the wellhead housing. This type of tree is normally run on a completion riser that has two strings of conduit and this is known as a dual bore completion riser. In such a completion riser, one string extends from the production passage of the tree to the surface vessel, whilst the other string extends from the tubing annulus passage in the tree to the surface vessel.

To assemble and run such a dual bore completion riser is very time-consuming. In addition, drilling vessels may not have such a completion riser available, requiring one to be supplied on a rental basis and, furthermore, in deeper waters it is often technically difficult to configure such a dual bore riser.

With such conventional tubing hanger types, the tubing hanger is installed before the tree is landed on the wellhead housing and tubing is typically run on a small diameter riser through the drilling riser and blow-out preventer (BOP). Before the drilling riser is disconnected from the wellhead housing, a plug is installed in the tubing hanger as a safety barrier. This plug is normally lowered on a wireline through the small diameter riser. After the tree is installed the plug is then removed through the riser that was used to install the tree.

This sequence of events requires that a mobile offshore drilling unit (MODU) type of vessel is necessary to affect well desuspension because conduits must be established between the vessel and the production tree through which plugs may subsequently be pulled. It is desirable to be able to permit a well to be desuspended without the need to establish a dual bore riser to surface and thereby permit non-MODU type vessels to conduct xmas tree installation operations and desuspension operations.

Published international application WO 03/067017 (ABB Vetco Gray) discloses a hydraulic ram which is used to retrieve a plug from a tubing hanger. Although this arrangement allows the plug to be retrieved through a wellhead, it also requires a separate package to be run, established with the xmas tree, operated and retrieved, thus incurring substantial additional operational costs and risk.

SUMMARY OF THE INVENTION

It is a further object of the present invention to obviate the need for such a package and its associated operations.

It is also an object of the present invention to avoid the requirement for a separate trip needed for the valve and to permit remote actuation of the valve (for the life of the field).

This is achieved in the broadest aspect of the invention by incorporating a remotely actuatable valve into the production bore of a tubing hanger. The valve is hydraulically operable and may be controlled via the tubing hanger running tool or via the xmas tree. The valve can be closed and tested after the tubing hanger has been installed, thereby isolating the well. The dual bore riser and running tool are retrievable and the MODU type vessel is then free to continue drilling and completion operations elsewhere. The xmas tree can therefore be deployed from a workclass supply boat instead of a MODU type vessel. Furthermore, because desuspending the well no longer requires a dual bore riser to be established to surface, true deployment and desuspension is conducted from a suitably configured utility vessel, such as an anchor handler or supply type vessel. The xmas tree is run from the utility vessel and established with the subsea wellhead and, after completion of appropriate testing, the suspension valve is opened, thereby desuspending the well.

It will be understood that the suspension valve essentially replaces a plug which may be run or retrieved on wireline or by some other means. Because there is a wide variety of equipment and techniques available to retrieve obstinate stuck plugs, the valve system in accordance with the broadest aspect of the invention also incorporates contingency features which permit the valve to which control has been lost and which is in the closed condition to be overridden to the open position. This continuous override system is consistent with a supply boat/anchor handler deployment philosophy outlined above. A further inventive aspect of the contingency system is provided by the inclusion of a mechanical nipple attached to the actuation mechanism of the valve and the actuation mechanism interfaces with the hydraulic ram attached to the top of the xmas tree or safety package, such as to allow the valve to be overridden.

Thus, the present invention not only comprises a completion suspension valve which permits the wells to be conveniently isolated and de-isolated but incorporates an override means by which a closed valve may be overridden to the open position with the overriding means not requiring a rigid riser to surface.

In a preferred arrangement, the fact that the hydraulic ram has the means to deploy and manipulate the override device has certain implications. For both manufacturability and operability, the hydraulic ram requires to have a relatively short maximum length so that the reach of the ram into the well is somewhat limited.

It is therefore desirable that the valve override nipple is located as near to the top of the well as possible. In the interests of simplicity and reliability, the override nipple is connected directly to the valve operating mechanism and, consequently, it is advantageous that the valve itself is located as near to the top of the well as possible. In practice, the maximum length of the hydraulic ram is about 30 ft.

The completion suspension valve has the essential requirement that it contains pressure from below. However, the valve must also contain pressure from above, such that it may be tested prior to disconnection of the running tool and subsequent departure of the rig. Where the available envelope, i.e. the volume within or surrounding a bore is restricted, flapper and ball type valves are typically used as they offer the best combination of throughbore and pressure capacity for a given body volume. However, it should be noted that flapper valves do not typically offer a bidirectional sealing capability. Thus, apertured ball valves may fulfill the identified requirement but existing solutions require a centralised ball valve which does not fit within the established envelope restrictions of a tool.

It is a further object of the invention to provide a valve arrangement which is useable within existing envelope restrictions to provide a completion suspension valve, instead of a plug.

In accordance with one aspect of the present invention, there is provided a method of suspending the well comprising the steps of:

providing a dual bore tubing hanger having an annulus bore and a production bore;

disposing a remotely operable valve in the production bore, and actuating remotely the valve moved between an open and a closed position.

According to another aspect of the present invention there is provided a completion suspension valve system comprising:

a suspension valve housing, said valve housing having a production bore;

a valve element disposed in said suspension valve housing;

said valve being remotely actuatable between an open position and a closed position.

According to a further aspect of the present invention there is also described a method of remotely suspending a well as claimed in claim 14, a ball element for use in a completion suspension valve as claimed in claim 19, a ball valve seat for use with the ball element as claimed in claim 21, a ball valve actuating mechanism as claimed in claim 23, a method of opening a closed ball valve and locking it in the open position as claimed in claim 24, a completion valve override system as claimed in claim 25, applications of the valve as claimed in claims 26, 27 and 28 a ball actuation mechanism for moving an apertured ball tube using a single actuatable rod as claimed in claim 34, and a method of opening a closed ball valve and retaining it in an open position using a sealing override plug as claimed in claim 35.

BRIEF DESCRIPTION OF THE DRAWINGS

These and other aspects of the invention will become apparent from the following description when taken in combination with the accompanying drawings in which:

FIG. 34*a* depicting the flapper valve in a closed position, i.e. during installation.

DESCRIPTION OF PREFERRED EMBODIMENTS

Figure 1:
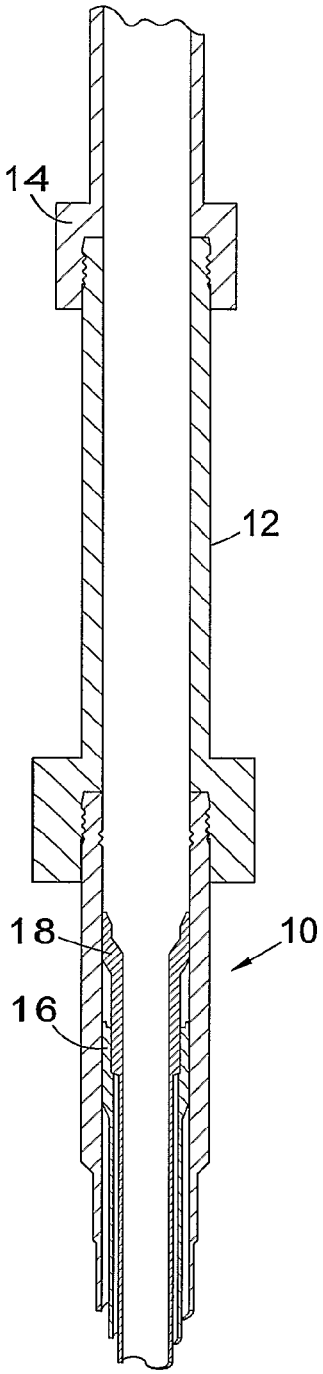
FIG. 1 is a diagrammatic longitudinal section of a wellhead system, BOP and marine riser for use with a completion suspension valve according to a first embodiment of the invention.
Figure 2:
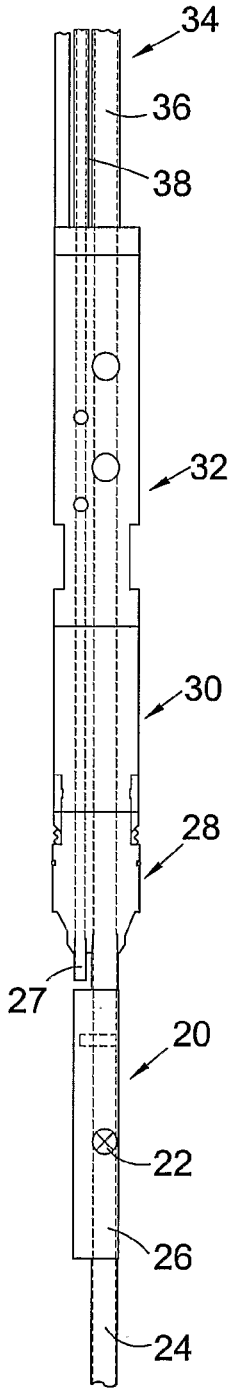
FIG. 2 is a similar diagrammatic view to FIG. 1 but of a completion string to be inserted into the BOP and wellhead system, the string including a completion valve sub, a tubing hanger, a tubing hanger running tool and a dual bore sub sea test tree.
Figure 3:
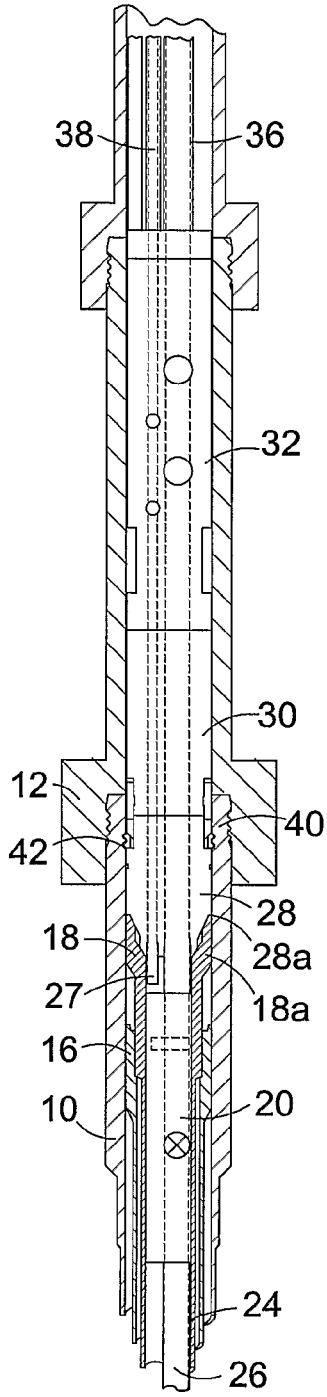
FIG. 3 shows the completion string of FIG. 2 inserted into the wellhead system of FIG. 1 with the tubing hanger locked into the wellhead.

Reference is first made to FIGS. 1 to 3 of the drawings. FIG. 1 depicts a longitudinal section of a wellhead system, BOP and marine riser for receiving a completion string with a suspension valve as shown in FIG. 2. The wellhead system depicts a wellhead 10 to which is coupled a blow-out preventer 12 to which in turn is coupled a marine riser 14. Within the wellhead 12 there is shown intermediate casing 16 which is typically 13⅝" in diameter and within the intermediate casing, inner casing 18, which is typically 10¾" in diameter. The foregoing structure typically forms a subsea wellhead system into which tools are run for well completion.

The completion string shown in FIG. 2 consists of a suspension valve sub or housing 20 in which is located in a suspension valve 22, which will be later described in detail, and which is coupled to completion tubing 24 which defines a production bore 26 and annulus bore 27 which runs through the completion sub 20. The housing 20 is coupled to a tubing hanger 28 which in turn is mounted to a tubing hanger running tool 30 which is in turn coupled to a 5"×2" subsea test tree 32. The subsea test tree 32 is in turn coupled to a dual bore riser 34 which consists of a production riser 36 and an annulus riser 38.

In use the completion string shown in FIG. 2 is run into the wellhead system shown in FIG. 1 to arrive at the arrangement shown in FIG. 3 where the tubing hanger 28 is locked into the wellhead 10 with shoulders on the tubing hanger 28*a* abutting the inner faces 18*a* of the inner casing. In this position a locking profile 40 of the tubing hanger engages with a mating recess 42 in the interior surface of the wellhead to lock the completion string into the wellhead system in the position shown in FIG. 3.

Figure 4:
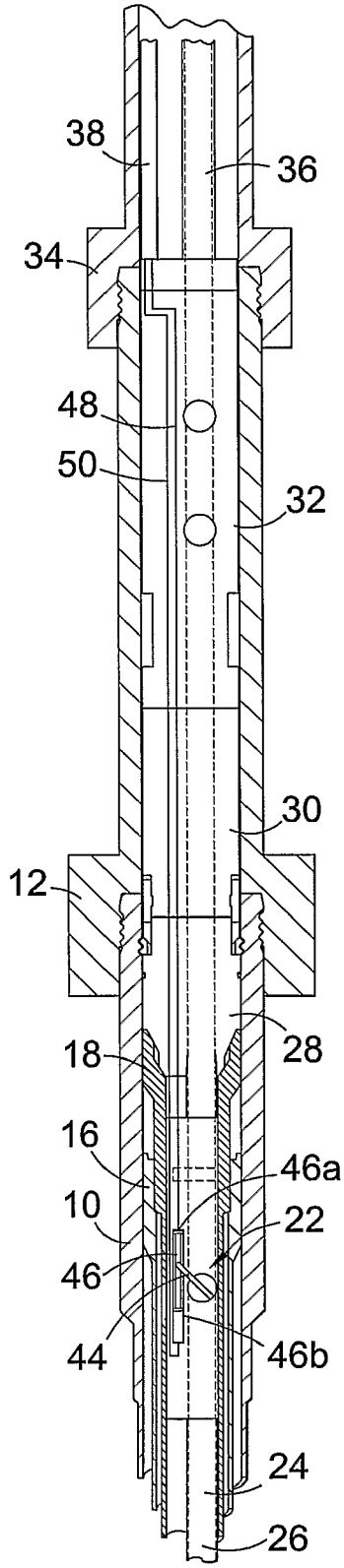
FIG. 4 is a similar view to FIG. 3 but with more detail depicting the hydraulic lines coupled to the completion valve when in installation mode, the valve being shown in the closed position.

Reference is now made to FIG. 4 of the drawings which depicts a view of the wellhead part of FIG. 3. In this diagram, the valve 22 is shown in further detail with the valve being clearly depicted within the production bore 26 and having a valve actuation bar 44 shown coupled to a guide shaft 46. It will be seen that the upper and lower ends of the guide shaft 46*a*,46*b* respectively are coupled to hydraulic lines 48,50 which pass through the completion sub housing, tubing hanger 28 and into the tubing hanger running tool 30 for connection to a source of hydraulic power (not shown) for actuating the guide shaft 46 to cause the suspension valve 22 to move between an open and a closed position, which will be later described in detail.

Figure 5A:
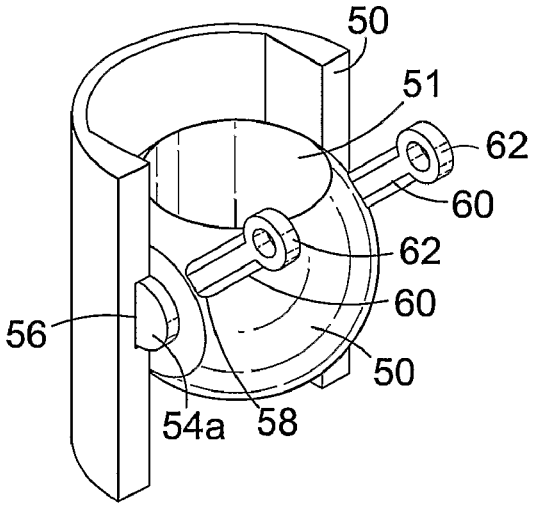
FIGS. 5*a, b* and *c* depict a central ball valve element mounted in a housing and shown in an open, intermediate and closed condition to facilitate explanation of operation of FIG. 4 but with bar pockets also shown.
Figure 5B:
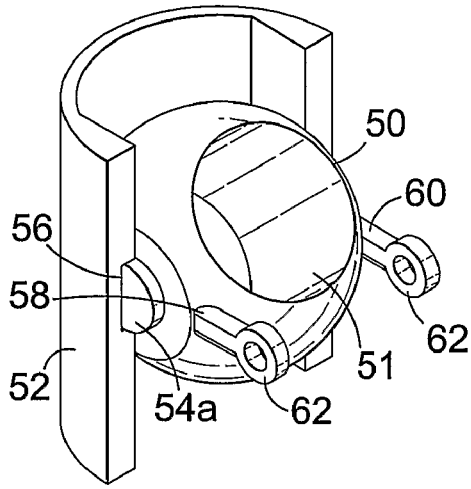
FIG. 5*d* shows a side elevation of the arrangement.
Figure 5C:
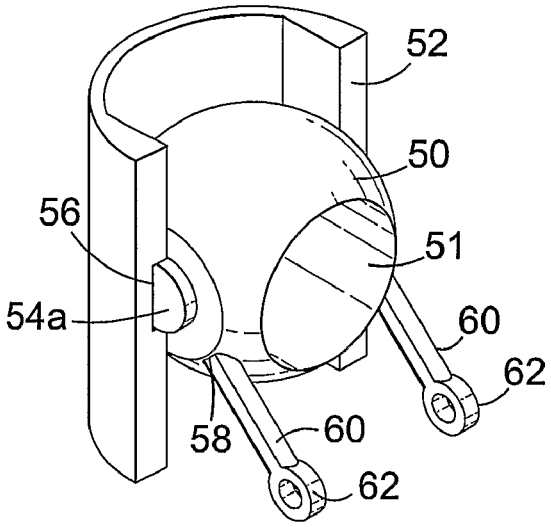
Figure 5D:
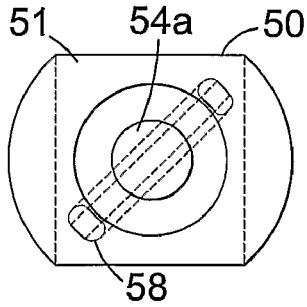

The suspension valve 22 is based on a rotatable apertured ball valve element similar to the type shown in FIGS. 5*a* to 5*d* of the drawings. FIGS. 5*a, b* and *c* depict a ball valve element 50 with a central aperture 51 being rotatably mounted in a conduit body 52. This central aperture element is described first to facilitate understanding of the operating principle. It will be seen that the ball valve element has a pair of trunnions 54 (only one of which 54*a* is shown in detail) which are mounted on circular recesses 56 in the longitudinal conduit body. The ball element 50 has a pair of bar pockets 58 (one of which is shown) for receiving a pair of actuation bars 60. The actuation bars have bar ends 62 which may be coupled to guide shafts similar to the guide shaft 46. The guide shafts 46 are constrained to move rectilinearly and, as they move, they move the actuation bars 60. The actuation bars are slideable relative to the centred ball valve 50 such that, as the bars move vertically downwards, the ball valve moves from the open position shown in FIG. 5*a* through a partially closed position as shown in FIG. 5*b* when the bars have been rotated approximately 45° to a fully closed position shown in FIGS. 5*c* where the bars have been rotated through approximately 90°. It will be noted that in the positions 5*a*, 5*b* and 5*c* bar ends 62 have moved relative to the ball valve element 50 so as to allow the ball valve 50 to rotate between the open and closed positions shown in FIGS. 5*a* and 5*c* respectively. FIG. 5*d* depicts a side view of a ball valve element 50 without the actuation bars with the position of the bar pocket shown in broken outline. It will be appreciated that because the actuation bars 60 slide relative to the ball element, the locus of movement of the bar ends 62 is a straight line.

Figure 6A:
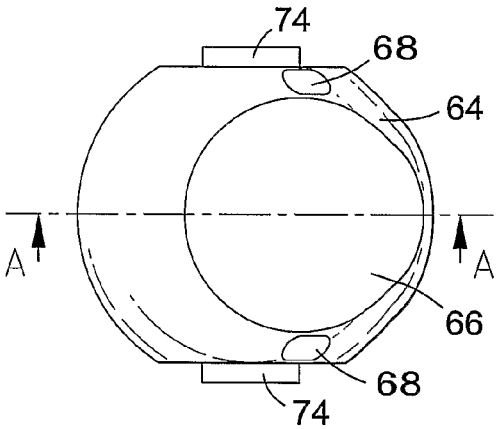
FIGS. 6*a, b* and *c* are top, front and perspective views of an offset ball valve element used in the completion sub of FIG. 4 in accordance with a preferred embodiment of the present invention.
Figure 6B:
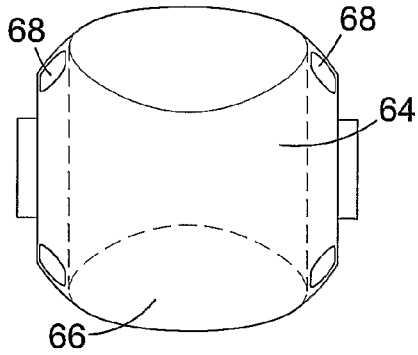
FIG. 6*d* is a sectional view taken on A-A of FIG. 6*a;*
Figure 6C:
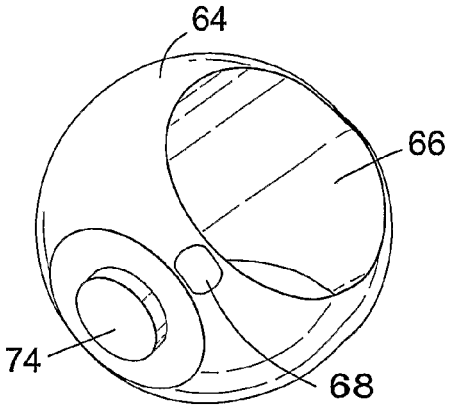
Figure 6D:
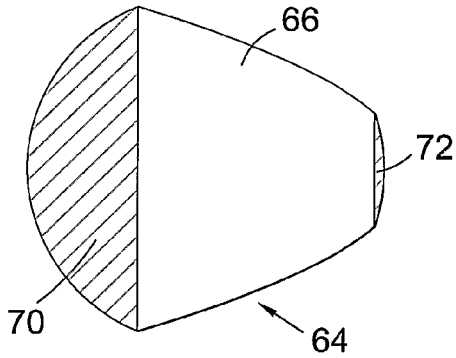

Reference is now made to FIGS. 6*a* to *d* which depicts a similar apertured ball valve element but one in accordance with a preferred embodiment of the present invention. The ball valve element is an offset ball valve element as best seen in the top view of FIGS. 6*a* to 6*d* of the drawings. The offset ball valve element 64 operates in a similar way to the centre ball valve element and it will be seen that the valve element 64 has an offset bore 66, best seen in FIG. 6*a*, and also has two bar pockets 68. FIG. 6*b* shows a front view and FIG. 6*c* is a perspective view. A sectional view taken on A-A to FIG. 6*a* is shown in FIG. 6*d* and it will be seen that one part of the ball element 70 has a greatly thickened section and the front section 72 is relatively thinner, this being the result of moving or offsetting the bore 66 from the centre. The offset ball element has trunnions 74 which project a short distance envelope from opposite sides. Trunnions 74 allow the ball element to be mounted within the valve housing 20, as will be later described in detail, typically via bearings and the trunnions also further define an axis about which the ball element 64 rotates. The valve bore 66 is offset in one direction from the centre of the spherical ball element but the bore as best seen in FIG. 6*a* is still centrally disposed between the trunnions 74. In this particular application the production flow bore 26 is extremely close to the outside diameter of the valve element 64 so that this does not permit a ball element with a centred bore as shown in FIGS. 5*a* to 5*c* to be accommodated. Accordingly, the offset ball element permits an offset centred ball valve to be disposed in the production bore 26 of the completion sub-structure shown in FIGS. 1 to 4 and allows a ball valve element to be used as a basis for the completion suspension valve 22. As will be later described in detail, a further advantage of the offset bore is revealed when the valve is viewed in the closed condition. The offsetting of the bore 66 allows less material to be present on one side of the ball to create the thin section 72 but also allows more material to be present on the other side of the ball to create the thick section 70. As will be further described in detail, the thick portion 70 of the ball element is load-bearing under differential pressure in the closed condition and the increased thickness of portion 70 of the ball element 64 results in an increase in the differential capacity of the valve 22. Therefore, for a given sphere and bore size differential pressure bearing capability is increased by offsetting the bore 66.

Figure 7A:
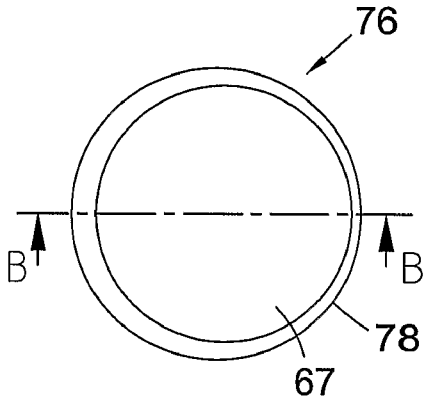
FIGS. 7*a, b, c* and *d* depict respective top, side and front views of an offset bore seat for engaging with the ball element of FIGS. 6*a*-6*d;*
Figure 7B:
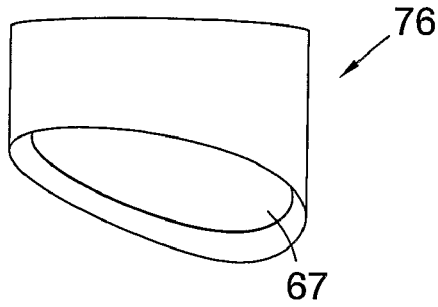
FIG. 7*d* is a sectional view taken on the lines B-B of FIG. 7*a;*
Figure 7C:
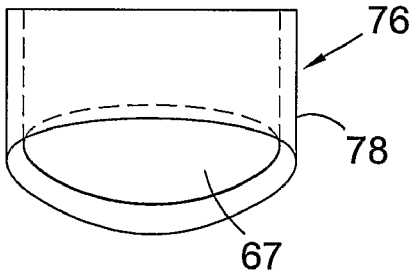
Figure 7D:
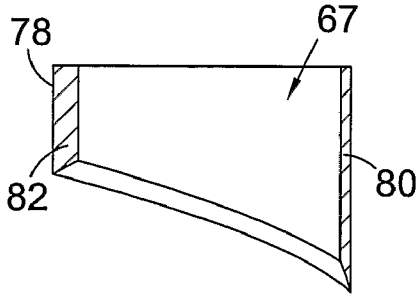

Reference is now made to FIGS. 7*a, b* and *c* of the drawings which depicts various views of an offset bore valve seat 76 for engaging with the ball element shown in FIG. 6. In particular, FIG. 7*a* is the top view of the seat, FIG. 7*b* is a side view and FIG. 7*c* is a front view. FIG. 7*d* is a sectional view taken on lines B-B shown in FIG. 7*a*.

It will be understood that the seat 76 acts as an intermediate seal element between the ball 64 and the valve housing 20. In traditional apertured ball valves, such as the centred apertured valve shown in FIGS. 5*a-d*, the valve seat is a cylindrical element where the outside diameter of the cylinder interfaces with a bore in the body called a seat pocket. The bore of the cylinder is equivalent to, and axially aligned with, the bore of the valve. A partially concave hemispherical surface is disposed at one end of the cylinder. This surface interfaces with the spherical surface of the ball element. In traditional arrangements of centred ball valves, the bore, the outside ball diameter and the partially concave hemispherical end surfaces all share a common centre line and all these features may be considered to be concentric to one another. In the embodiment shown in FIGS. 6 and 7, it will be understood that the offset bore of seat 76 and the outside diameter or surface 78 of the seat 76 do not share the same general position as the axial centre lines are offset from one another. This offsetting results in a thin seat wall 80 occurring at one side of the valve seat 76 and the relatively thicker or heavier wall 82 occurring at the other side of the valve seat. This is best seen in FIG. 7*d*. In applications where the valve flow bores 66,67 are extremely close to the outside diameter of the valve body or housing at a particular point, there is insufficient room to accommodate a valve seat with a concentrically disposed bore because there would be too much material in the seat wall for the limited space available. When the valve seat 76 with the offset bore 67 is used, then the valve seat 76 is aligned such that the thinnest portion of the seat wall 80 is coincident with the space-constrained portion of the body. A further advantage of offsetting the bore 67 is that a larger outside diameter of seat 76 may be accommodated and the larger the outside diameter of the valve seat 76, the greater is the area of contact that may be offered to the ball element 64 via the partially hemispherical face. This contact area is important as the bearing stresses that develop during differential loading of the valve are transmitted through this surface and offsetting the bore 66,67 permits the larger outside diameter which permits a larger pressure differential capacity to be used for a given bore and given offset ball valve body size.

Figure 8A:
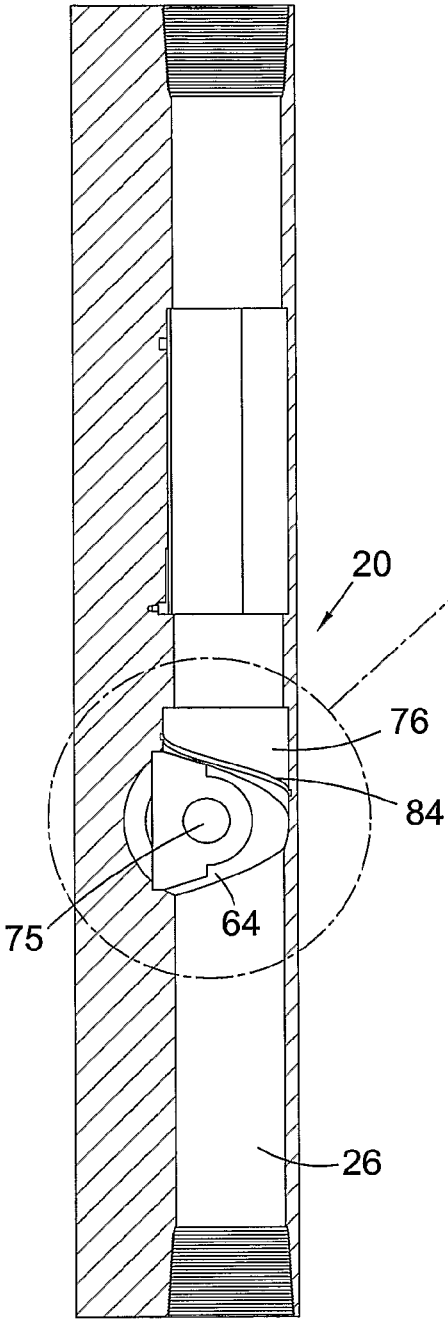
FIGS. 8*a, b* and *c* depict longitudinal partly sectioned and partly cut-away views respectively of a completion suspension valve sub with a ball element seat pocket for receiving an offset ball element as shown in FIGS. 6*a* to *d* and an offset bore seat as shown in FIGS. 7*a* to *d;*
Figure 8B:
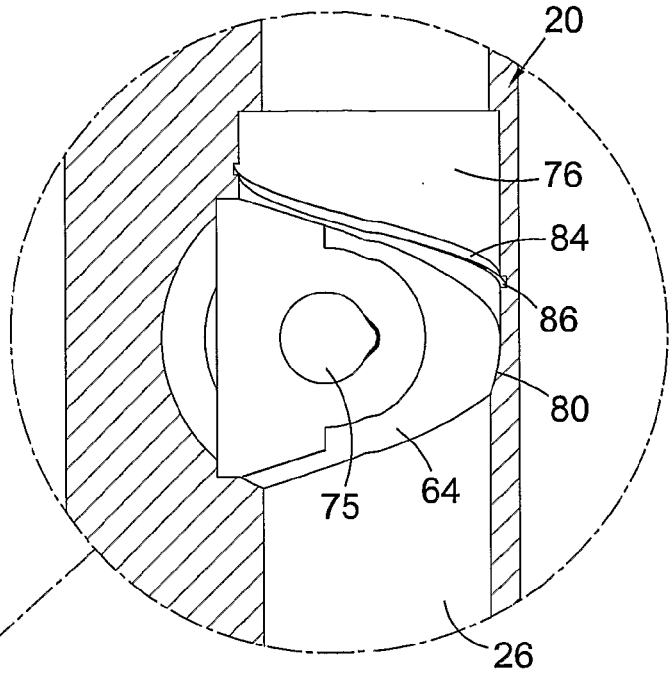
Figure 8C:
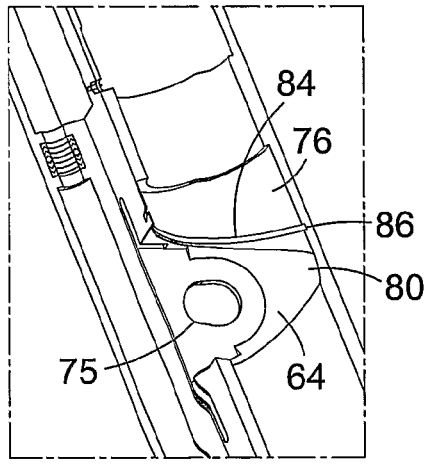

A further function of the offset ball valve seat 76 is to engage sealingly with the valve element 64. This seal is normally achieved by the incorporation of a resilient seal such as an elastomer O-ring between the valve seat and the seat pocket of the body. This elastomeric seal becomes fully effective when the valve is closed and the differential pressure is present across the valve. In traditional designs the valve seat is of the concentric type as described above and an elastomeric seal sits in a groove parallel to the end face of the seat and normal to the cylindrical axis of the seat pocket. However, because the offset valve seat has a portion with a thin wall 80, the thinness of the wall may become a limiting factor in the ability of such a valve seat to contain such a differential pressure. Accordingly, the applicant, which involves providing a seal groove at an inclination such that at its lowest point the seal groove is orientated to be coincident with the thinnest portion of the offset valve seat 80 so that the length of the thin portion of the seat, which is exposed to the differential pressure, is minimised, presents a further inventive feature. This is best seen in FIGS. 8*a*, 8*b* and 8*c* of the drawings which show respectively longitudinally partly sectioned views and partial cut-away views of a completion valve sub with a ball element seat pocket for receiving the offset ball element 64 shown in FIGS. 6*a* to 6*d* and the offset ball valve seat 7*a* to 7*d*. As best seen in FIG. 8*b*, the completion valve sub 20 defines the production bore 26 including trunnion receiving recesses 75, only one of which is shown in the interests of clarity, for receiving the trunnion 74 of the offset ball valve element 64. The offset ball valve is shown coupled to the offset ball seat 76 via an inclined or helical groove 84. It will be best seen in FIG. 8*b* that the lowermost point of the groove 86 is adjacent to the valve seat 76 at the point where there is a thin section 80. In this position, when the ball 64 contacts the seat 76, i.e. at the bottom of the seat, then the thin portion 80 of the seat gains support from the presence of the ball section 72 and the unsupported thin section or portion of the seat 76 is protected from differential pressure by the presence of the inclined helical seal 86. Thus, it will be understood that the inclined seal groove 84 described above, when used in conjunction with the eccentric bore seat, maximises the bore size and differential pressure capacity of the suspension valve for a given bore offset and valve body diameter.

Figures 9A, 9B:
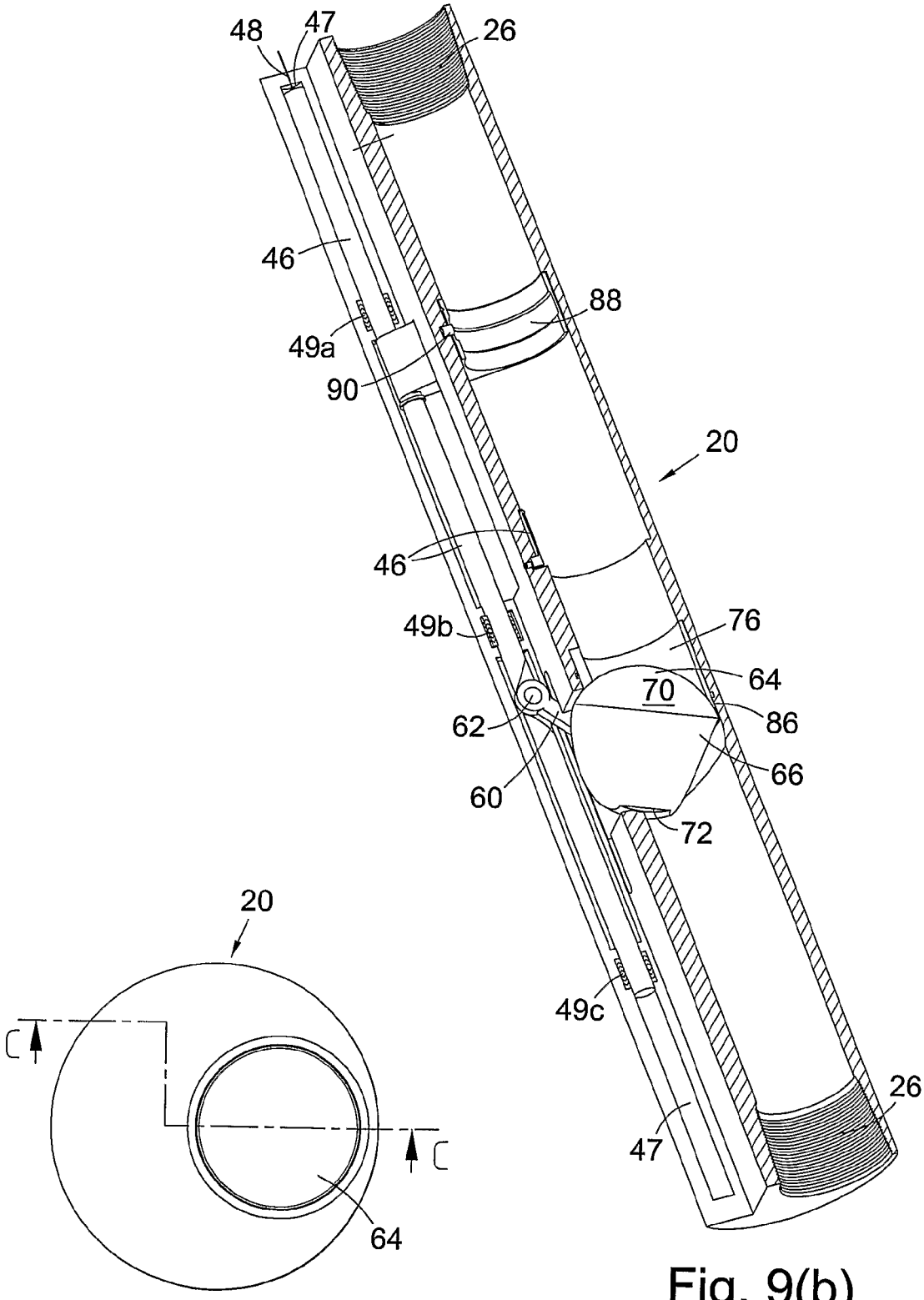
FIG. 9*a* is a plan view of the completion suspension valve showing the offset production bore.
FIG. 9*b* is a longitudinal sectional view taken on the lines C-C of FIG. 9*a* and depicting various completion suspension valve components.

Reference is now made to FIGS. 9*a* and 9*b* of the accompanying drawings. FIG. 9*a* depicts a top view of a completion sub housing 20 with the ball element 64 in the closed position and FIG. 9*b* is a longitudinal sectional view taken on the lines C-C of FIG. 9*a*, again showing the ball valve element in a closed position. It will be seen that the completion valve sub 20 has a housing which defines an elongate production tubing bore 26 in which is disposed the offset ball valve element 64. The offset ball valve element is shown in the closed position with the thicker section 70 uppermost and the thinner section 72 lowermost. One actuation bar 60 is shown with the bar end 62 coupled to a guide shaft 46 which is moveable in response to hydraulic pressure within elongate guide shaft recess 47. The shaft 46 is supported for movement by three chevron-bearing seals 49. The top of the recess 47 is coupled to a hydraulic line 48 which when pressurised forces the guide shaft 46 downwards such that the bar end 62 is moved down with the shaft 46, thus causing the ball element 64 to rotate to an open position, as will be later described in detail. The offset ball seat 76 is shown disposed just above the thickened ball section 70 and also the lower portion of the groove 86 is shown for receiving the inclined helical seal.

As will be later described in detail, the bore 26 contains a nipple 88 normally held in place to the housing 20 by a shear pin 90 which is engageable by a mandrel (not shown) for moving the nipple 88 when the ball valve has in the closed position and when shifted this nipple engages with a detent to retain the ball valve open; in this position it is known as the overridden open position.

Figure 10:
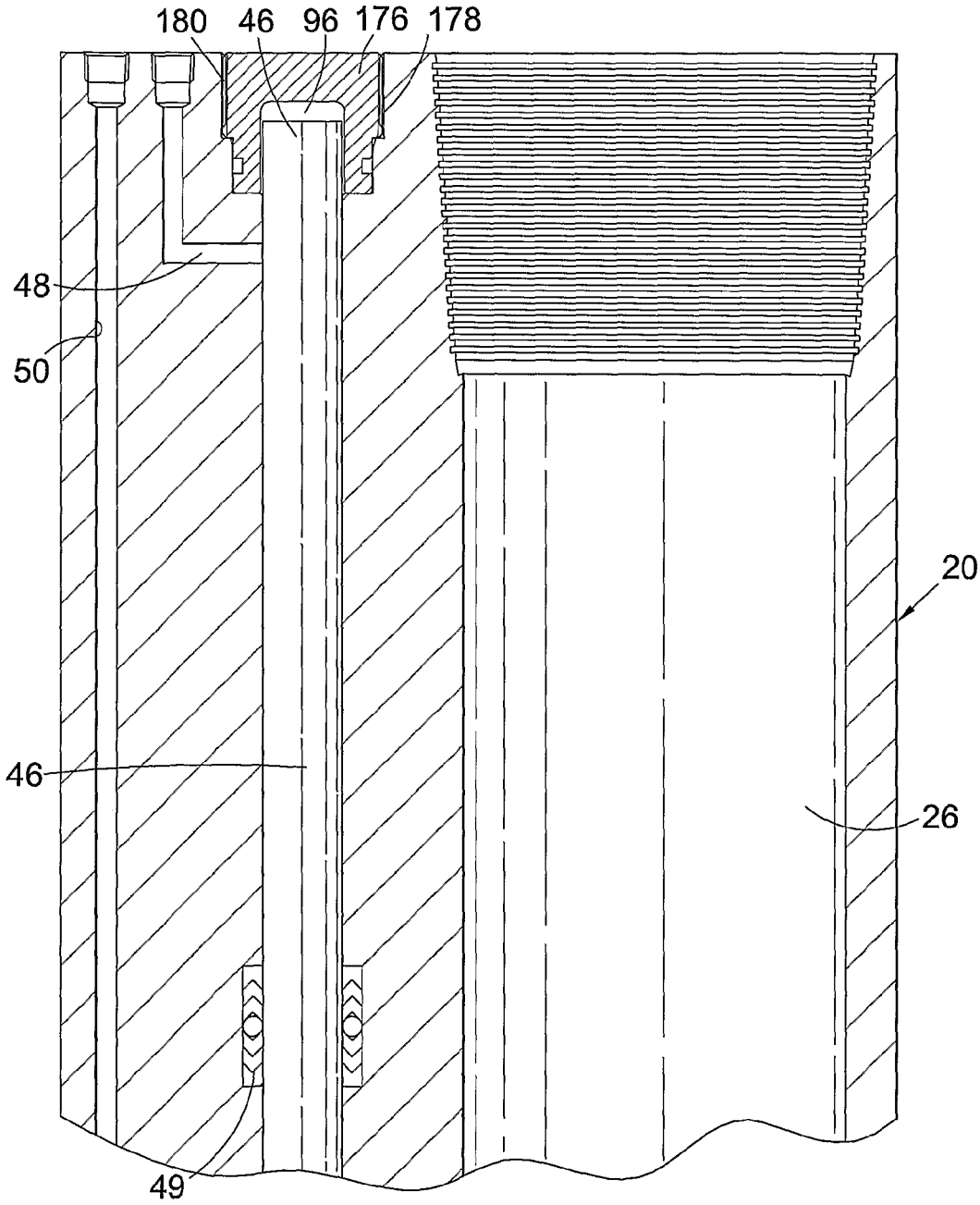
FIG. 10 is an enlarged detailed view of the top of the suspension valve housing.

Reference is now made to FIG. 10 of the drawings which depicts the top part of the completion valve sub 20 depicting the main bore 26 and the guide shaft bore 47 in which is disposed the elongate guide shaft 46. Also shown are the hydraulic lines 48, 50 which are coupled to opposite ends of the guide shaft recess 47 for actuating the guide shaft to move between the recess and open and close the ball valve.

Figures 11A, 11B, 11C:
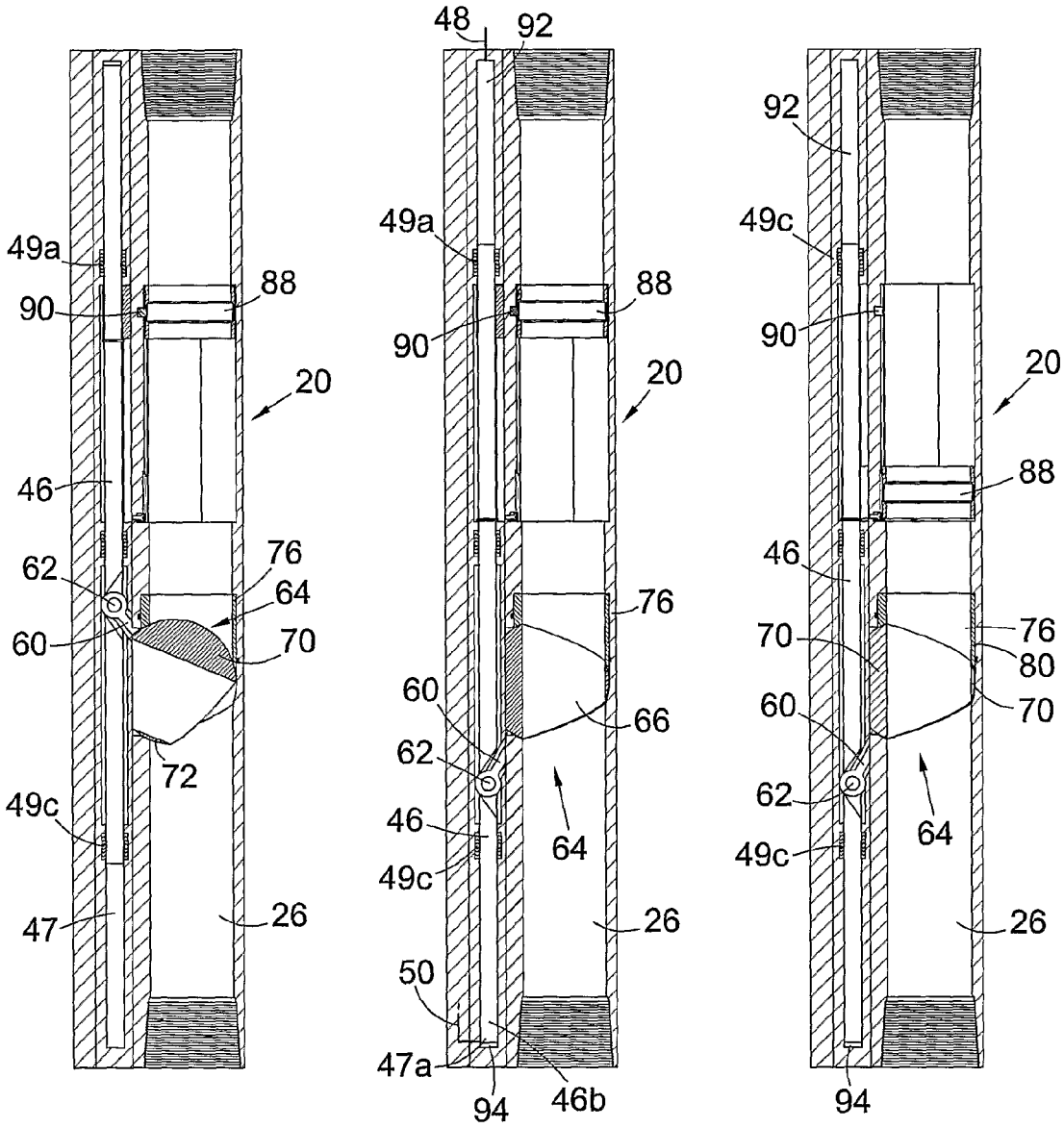
FIGS. 11*a, b* and *c* are respective longitudinal sectional views of the completion suspension valve assembly showing the valve in the normally closed, normally open and overridden open positions respectively.

Reference is now made to FIGS. 11*a*, 11*b* and 11*c* which are respective longitudinal section views of the completion suspension valve housing showing the ball valve 22 normally closed, the valve normally opened and the valve in the overridden open position respectively. In the interests of clarity, some parts previously described have been omitted such as the hydraulic lines.

Reference is first made to FIG. 11*a* of the drawings showing the ball valve in the closed position. There it will be seen that the thick section 72 is uppermost and abuts the offset ball seat 76. In this position, the nipple 88 is in the uppermost position. Reference is now made to FIG. 11*b* which depicts the ball element in the normally closed position. This has arisen by virtue of actuating the guide shaft 46 to move downwards within guide shaft bore 47 such that the bar ends 62 are disposed beneath the ball element 64. In this position, the bore 66 of the offset ball is aligned with the production bore 26, so there is communication through the entire production bore within the completion valve sub housing 20. It will be appreciated that the diameter of the bore 66 is the same as the main production bore diameter 26 and this is due to the fact that the offset ball valve element 64 is used.

A hydraulic piston is formed by the inclusion of a seal 49 between the shaft and the valve body near the upper end of the shaft bore 47. In the embodiment shown, the seal 49*a* is of a chevron or v-type packing and is made of non-elastomeric material, in this case Teflon, as a long service life is required. This type of seal is available from Greene Tweed although there are other suitable oilfield seals. A chamber 92 is formed by the inclusion of the seal 49*a* at the upper end of the shaft 46 and the hydraulic port 48 is provided in the upper surface of the housing and the chamber 92. For convenience, chamber 92 is generally identified as the valve open chamber.

A further hydraulic piston is formed by the inclusion of a seal 49*c* between the shaft 46 and valve body 20 near the lower end 47*a* of the shaft bore 47. Again, in this embodiment, the seal 49*c* is of the chevron or v-type packing. A chamber 94 is formed by the inclusion of this seal 49*c* at the lower end of the shaft 46 and the hydraulic port 50 is provided between the housing and this chamber 94 which is identified as the valve closed chamber.

When hydraulic control fluid is introduced to the valve open chamber 92, any fluid in the valve closed chamber 96 is permitted to be displaced as the actuation shaft 46 is moved downwards. The ends 62 of the bars 60 connected to the shaft 46 move sympathetically from the shaft via the pin joint connection. It will be understood that the bar position is constrained such that it must always project its axial centre line through the centre of rotation of the ball by virtue of engagement with the bar pockets 68. The bars 62 rotate about the ball centre and bear upon the inside faces of the bar pockets 68 into which they are engaged thereby causing rotation of the ball element 64 within the completion sub housing 20. As the guide shaft actuation stroke proceeds the distance between the shaft/bar connection point and the ball centre is reduced. In addition to rotating the ball element 64, the bar also engages further into the bar pockets to compensate for this diminishing distance. This situation prevails until the ball valve is rotated halfway in the actuation cycle at which point the reverse situation occurs and the actuation bars are retracted from the bar pockets and, as shown in FIG. 11*b*, full opening is achieved when the bottom end 46*b* of the guide shaft contacts the bottom surface 47*b* of the shaft bore 47.

FIG. 11*c* depicts the overridden position where it will be seen that the nipple 88 has been moved down towards the ball valve element 64 to lock the element in the open position as will be later described in detail.

Figure 12A:
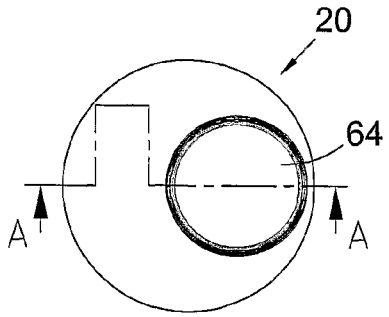
FIG. 12*a* is a plan view of a completion suspension valve with the ball element in the closed position.
Figure 13A:
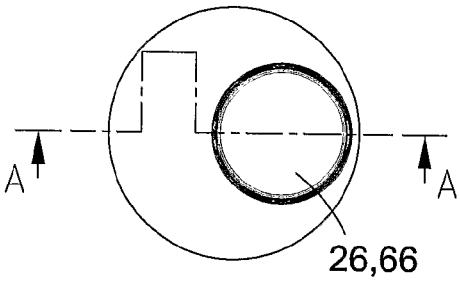
FIGS. 13*a, b, c* and *d* are views similar to FIGS. 12*a, b, c* and *d* respectively with the ball element in the open position.
Figure 13C:
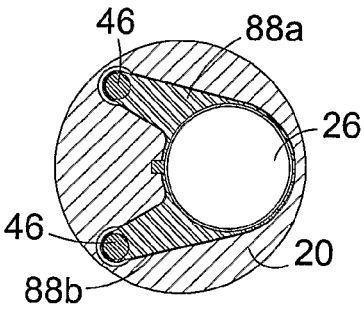
Figure 13D:
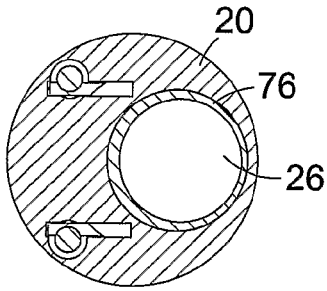
Figure 13B:
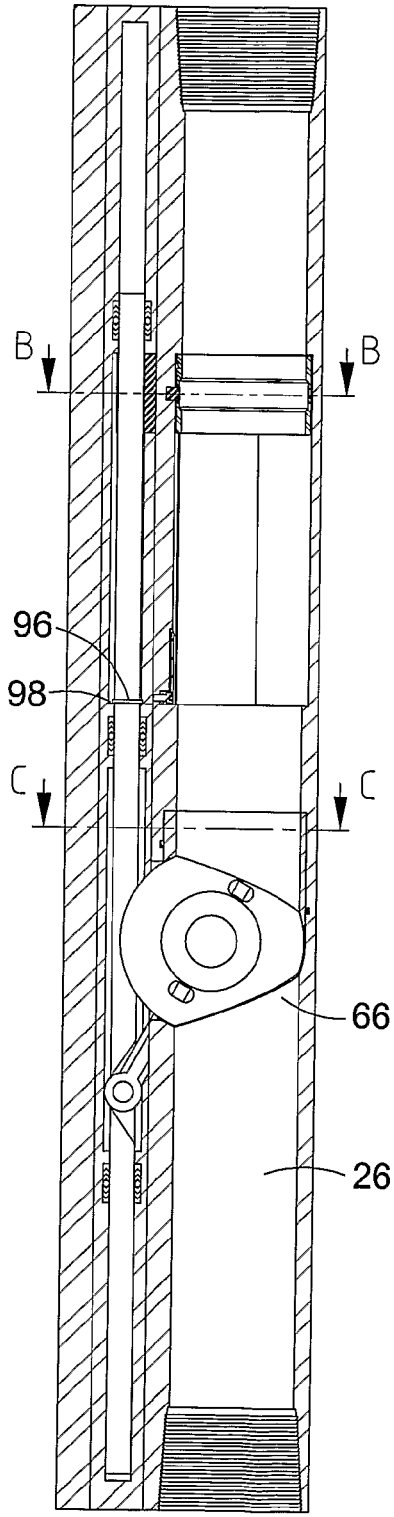

Reference is now made to FIGS. 12*a, b, c* and *d* which are diagrammatic views which better illustrate the completion valve assembly within the valves in the closed position, and to FIGS. 13*a, b, c* and *d* which better illustrate the same valve assembly but with the valve in the open position.

For convenience, FIGS. 12*a, b, c* and *d* should be read with FIG. 11*a* and likewise FIGS. 13*a, b, c* and *d* should be read with FIG. 11*b*.

Figure 12C:
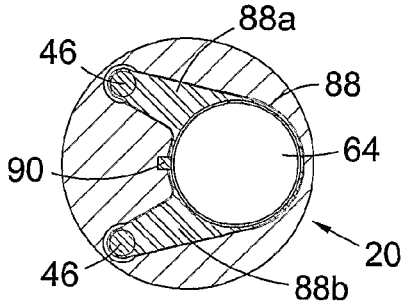
FIGS. 12*c* and *d* are cross-sectional views taken on the lines B-B and C-C respectively of FIG. 12*b;*
Figure 12D:
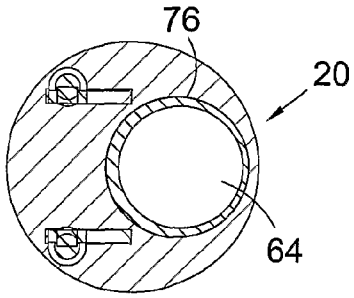
FIG. 12*b* is a longitudinal sectional computer aided design (CAD) of a suspension valve in the normally closed position taken on the line A-A of FIG. 12*a;*
Figure 12B:
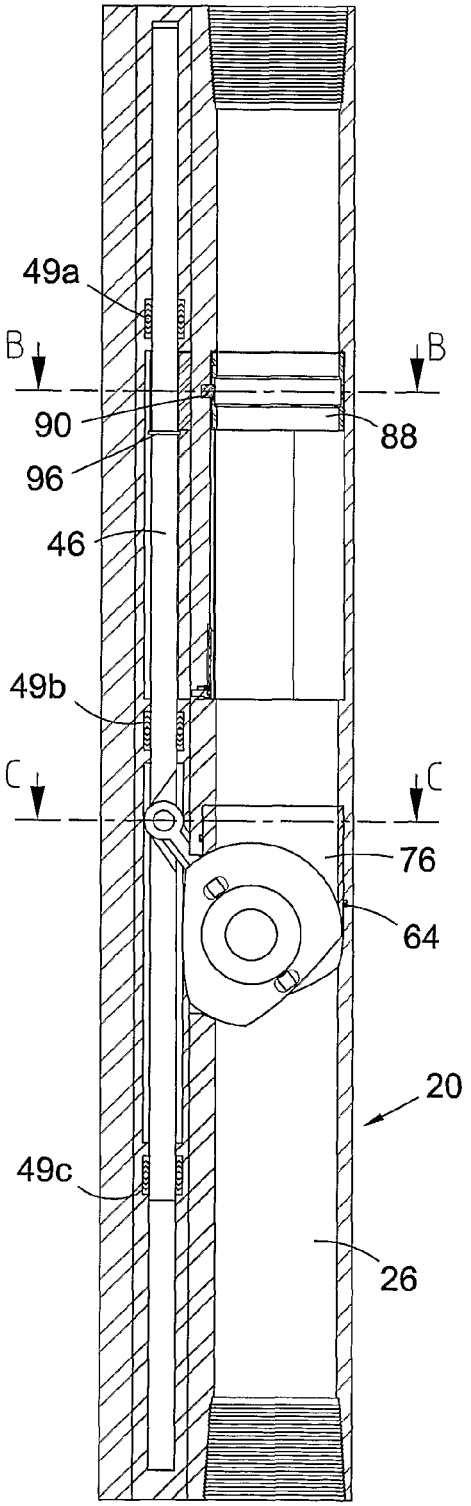

Turning first to FIG. 12, FIG. 12*a* shows a top view with the ball element in the closed position, and FIG. 12*b* is a section taken on the lines A-A of FIG. 12*a*. FIG. 12*c* is a section taken on lines B-B through the completion sub-housing at the level of the nipple, and FIG. 12*d* is a section taken through the completion sub housing and through the bar ends on lines C-C.

Like parts refer to like numerals already described and it will be noted that in FIG. 12*c* the nipple 88 has a general U-shape which surrounds the production bore 26 and also has legs 88*a* and 88*b* which surround respective guide shafts 46. Referring to FIG. 12*b*, it will be seen that the legs 88*a*,88*b* rest on an annular land 96 of the guide shafts 56 for forcing the guide shafts 46 into the open position as will be later described in detail. In the position shown in FIG. 12*b*, it will be seen that the nipple 88 is secured to the completion sub-housing 20 by virtue of shear pin 90, as, best seen in FIG. 12*c*.

Reference is also made to FIG. 13 which depicts the valve in the open position with the ball bore 66 aligned with the production bore. In the position shown in FIG. 13*b* it will be seen that the guide shaft 46 has been moved within the guide shaft bore 47 as previously described with the amount of travel being limited by the abutment of the annular land 96 on shoulders 98 within the shaft bore 47. Sectional views shown in FIGS. 13*c* and 13*d* are taken at the same level as those in FIGS. 12*c* and *d* for ease of comparison.

Thus, it will be understood that in response to hydraulic pressure applied via hydraulic lines 48,50 to the guide shaft 46, the shaft being coupled to the ball element 64 causes the ball element to move between closed positions shown in FIG. 11*a* and FIGS. 12*a-d* and the open position shown in FIG. 11*b* and on FIGS. 13*a-d*.

Figure 14:
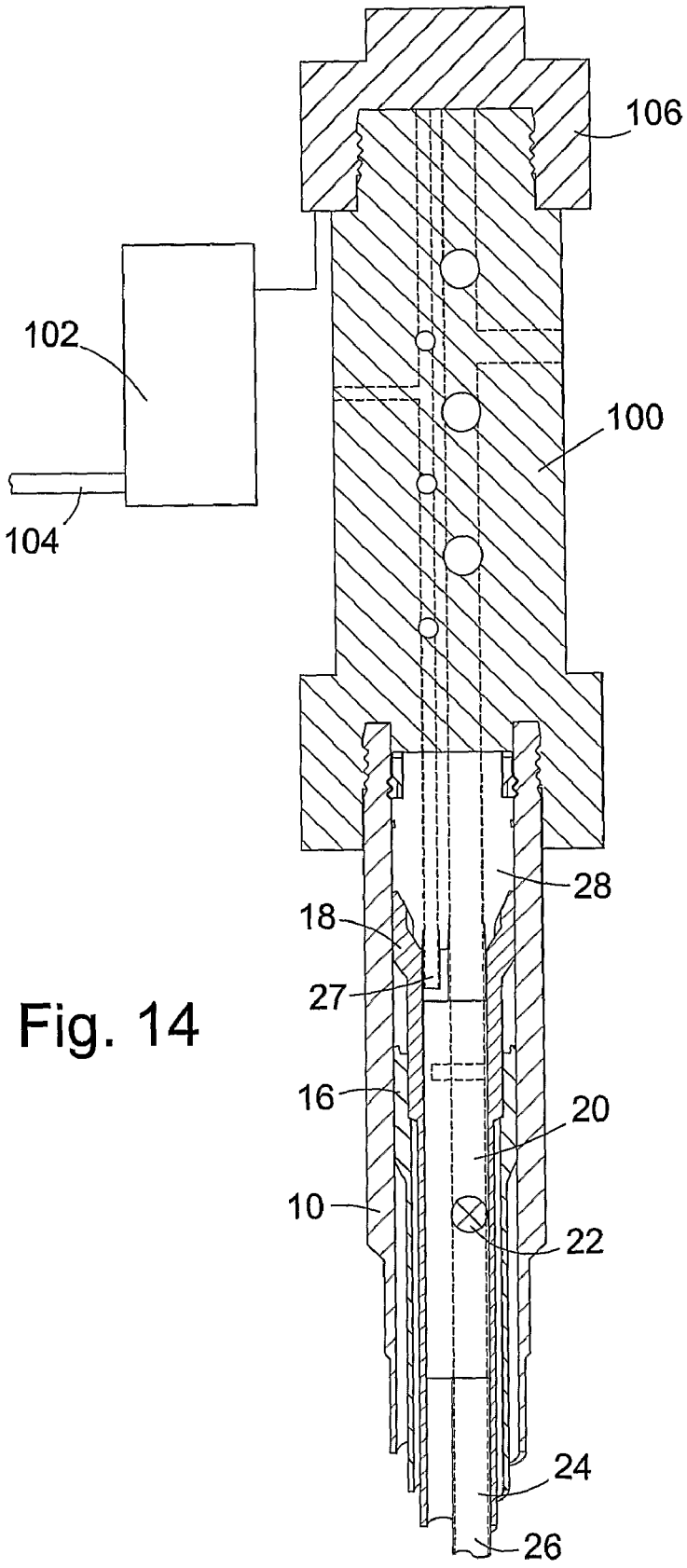
FIG. 14 is a view similar to FIG. 4 but depicting a completion suspension valve in production mode with a Christmas tree coupled to the wellhead and other production control elements coupled thereto.

Reference is now made to FIG. 14 of the drawings which depicts a wellhead with a completion suspension valve in accordance with an embodiment hereinbefore described disposed within the wellhead similar to that shown in FIG. 4 but the system is also shown in production mode with a dual bore production xmas tree 100 shown coupled to the wellhead, and the hydraulic control system 102 shown coupled to an umbilical 104 and the production xmas tree 100 for controlling hydraulic operation of the completion suspension valve 22, as well valves within the production xmas tree 100. At the top of the xmas tree 100 is a tree cap.

Figure 15A:
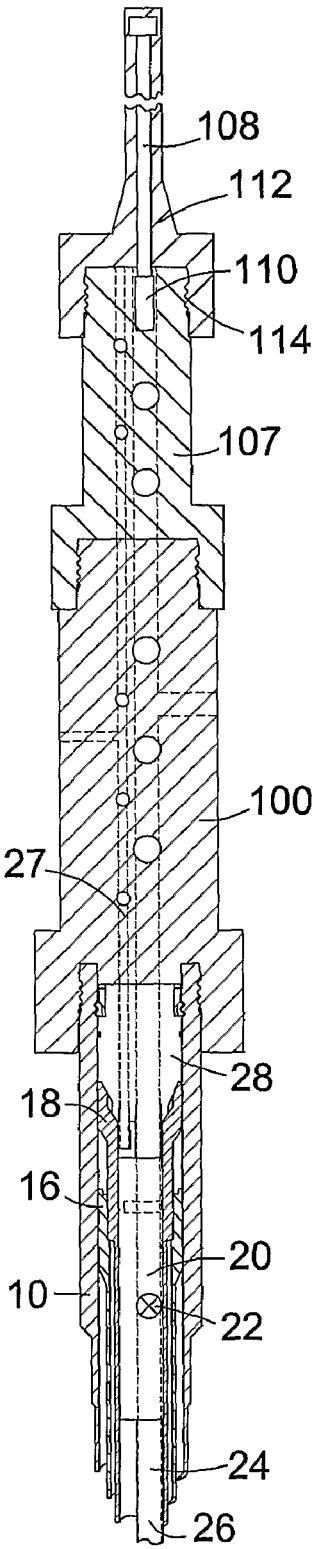
FIGS. 15*a* and 15*b* depict a production control system similar to that shown in FIG. 14 but with an axially movable ram shown retracted in FIG. 15*a* and extended in FIG. 15*b* for interfacing with an override mechanism of the completion suspension valve.
Figure 15B:
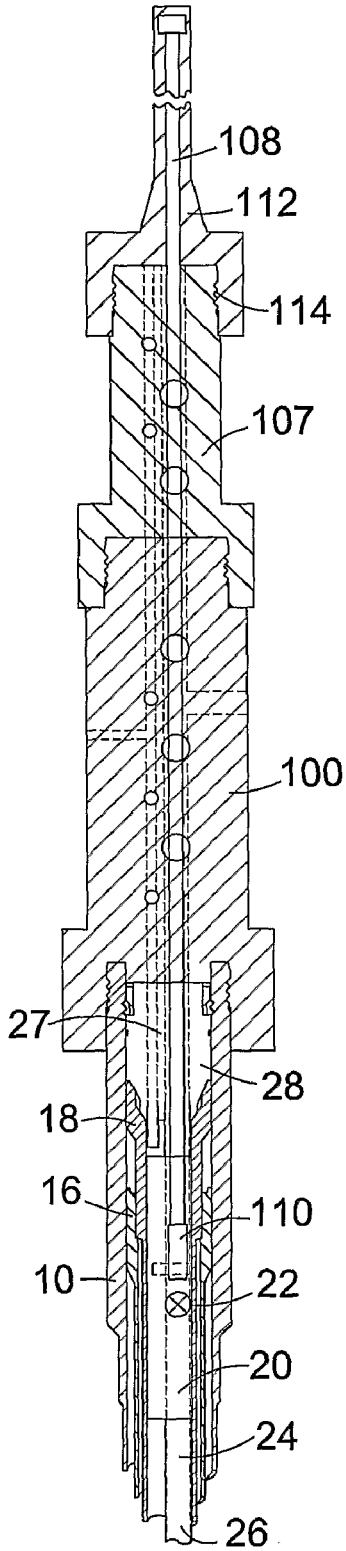

Reference is now made to FIGS. 15*a* and 15*b* of the drawings which are similar to FIG. 14 but which depict an isolation valve override piston 108 carrying a mandrel 110 shown coupled to the top of the lower riser package with the piston 108 being shown in the retracted position in FIG. 15*a* and being shown in the extended position in FIG. 15*b*. It will be seen that in FIG. 15*b* the piston 108 has a shaft which is sufficiently long to allow it to extend through the lower riser package 107, the xmas tree 100, the tubing hanger 28 and the top part of the suspension valve sub housing 20 for engaging with the override nipple 88 to lock the ball element in the open position as will now be described.

The hydraulic piston 108 is part of the valve override tool package which is extendable to deploy a tool which interfaces with the override nipple 88 of the valve 22. The piston 108 may be a multi-stage telescopic device and is extended and retracted by the supply of hydraulic chambers to fluid within the ram housing (not shown in the interests of clarity). As will be appreciated by a person of ordinary skill in the art, such an arrangement is consistent with double-acting hydraulic rams which are widely used throughout many areas of industry. The piston housing 112 is itself mounted to a hydraulic connector which, in turn, is connected to a profile 114 at the upper end of the subsea safety package and this connection allows both a structural and pressure type connection between these elements. A safety package consists of one or more valve or piston/ram elements disposed in the production bore and annulus bores which are capable of cutting obstructions and which may straddle them and thereafter sealing such that the well is isolated. The safety package is in turn connected to the top of the xmas tree 100 via a hydraulic connector (not shown in the interest of clarity) which allows a structural and pressure type connection to be established between the lower riser safety package 107 and the xmas tree 100.

Figure 16A:
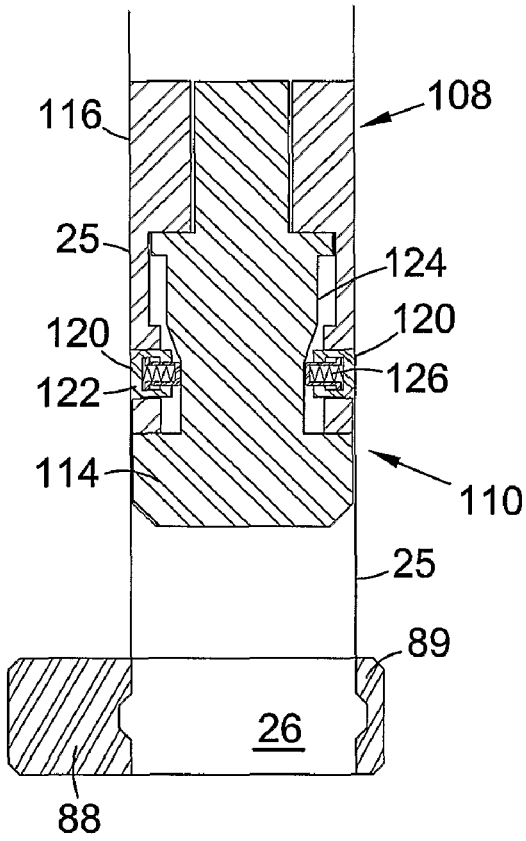
FIGS. 16*a, b* and *c* are longitudinal cross-sectional views through the lower mandrel portion of the hydraulic ram for engaging with an override nipple, FIG. 16*a* showing the mandrel prior to engagement with the nipple, FIG. 16*b* depicting the spring loaded dogs engaged with the override nipple and FIG. 19*c* showing the extended mandrel for valve override actuation.
Figure 16B:
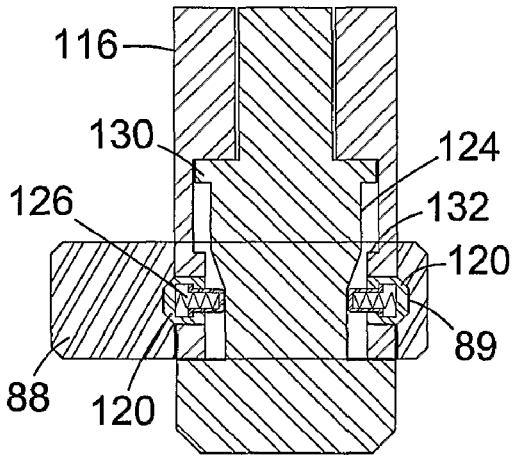
Figure 16C:
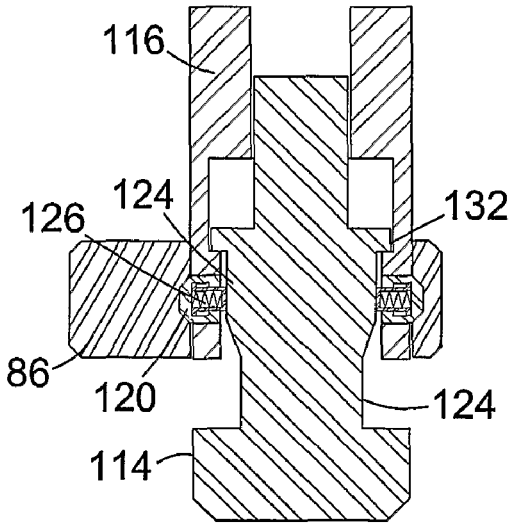

Reference is now made to FIGS. 16*a*, 16*b* and 16*c* of the drawings of diagrammatic cross-sectional views through part of the suspension valve sub 20 and, in particular, depicting a cross-sectional view through the nipple 88 and valve override tool/mandrel 110 at the lower end of the piston 108.

Reference is first made to FIG. 16*a* where it will be seen that the ram override tool or mandrel 110 consists of a lower mandrel portion 114 which is mounted and moveable within a mandrel sleeve 116. A pair of spring-loaded dogs 120 are located within windows 122 and are compressed between the surface of the mandrel 124 and the wall 25 of the production bore 20. The dogs have springs 126 which are shown compressed in FIG. 16*a* which is also the position for mandrel deployment so that the dogs are shown in the retracted position.

The overriding operation begins by establishing the tool package 110 on top of the xmas tree 100. This can occur subsea by establishing the package onto an already present xmas tree as described above or, alternatively, the xmas tree and override package may be run simultaneously and it will be appreciated that in the latter scenario the override package also incorporates the functionality necessary to run the xmas tree. As shown in FIGS. 15*a* and 15*b*, once the override package xmas tree and wellhead system are established, the xmas tree valves are opened and the override tool is extended into the position best seen in FIG. 15*b*.

Reference is now made to FIG. 17*b* which depicts the override mandrel 114 moved down relative to the nipple 88 such that the dogs 120 are disposed adjacent the circumferential nipple groove 89. In this position the springs 126 bias the dogs 120 into the groove 89 as shown in FIG. 16*b*, so that the body of the override tool is engaged with the override nipple 88. Further downward movement of the override tool causes the mandrel 114 to move downwards and causes the mandrel surface 124 to compress the springs 126 and support the dogs 120 in the position shown in FIG. 16*c*. In this case, the override tool 110 is securely engaged with the override nipple 88.

Figure 17:
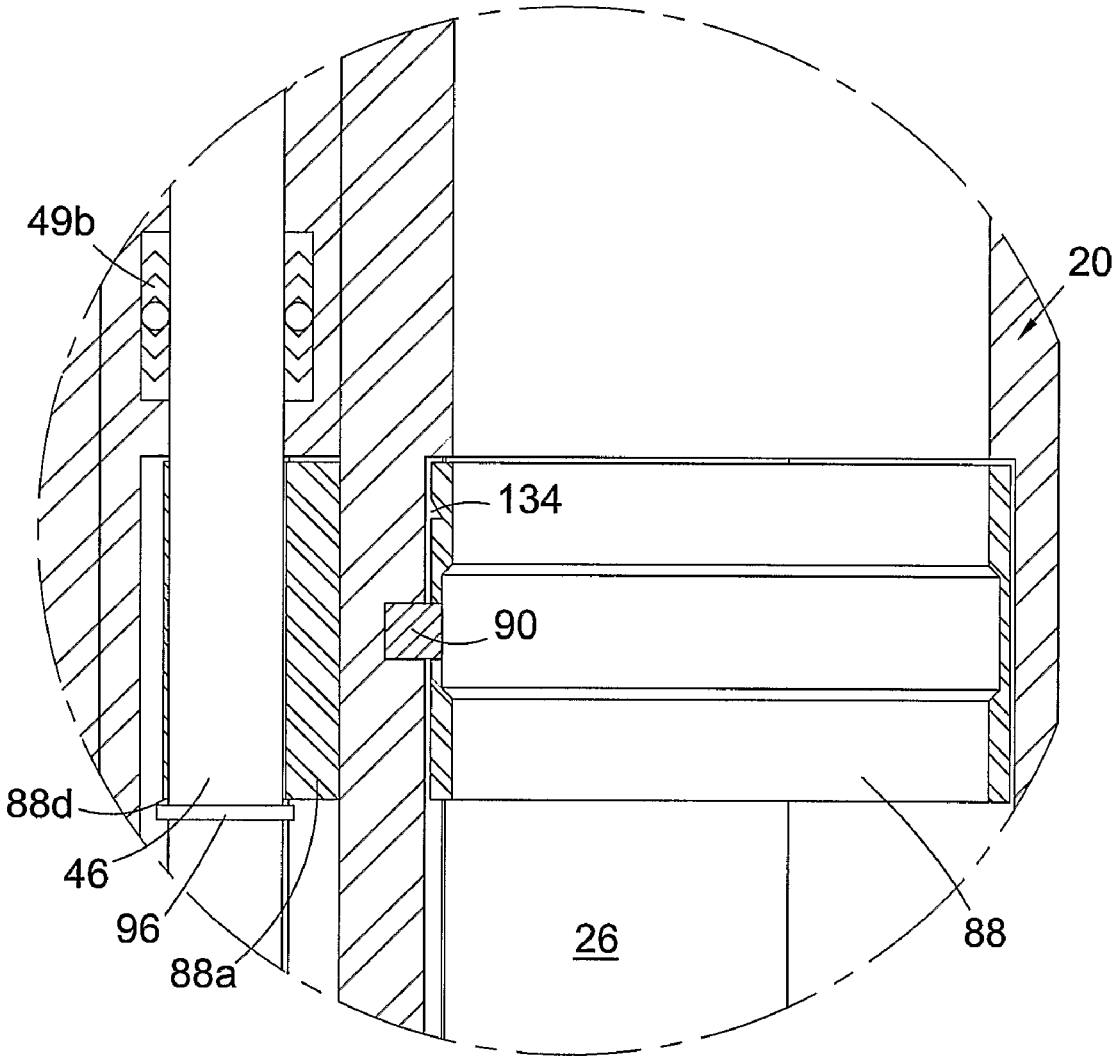
FIG. 17 depicts a side-sectional view, drawn to an enlarged scale, of the override nipple in the completion suspension valve bore prior to engagement by the mandrel as in FIG. 16*a;*

Reference is now made to FIG. 17 of the drawings which is an enlarged view of part of the completion valve sub housing as shown in FIG. 12*c* and showing the override nipple 88 connected to the suspension valve housing by virtue of the shear pin 90. It will also be clearly seen in FIG. 17 that the valve nipple and leg 88*a* have a lower portion 88*d* which abut an annular land on the guide shaft 46. Also, as shown in FIG. 16*c*, shoulders 130 of the mandrel engage with inner shoulders 132 of the mandrel sleeve. Continued pressure on the piston and mandrel forces against the override nipple 88 so the pressure is sufficient to shear the shear pin 90. When the pin 90 is sheared the nipple 88 is moved downwards to the position shown in FIG. 11*c*. Reference is also made to FIGS. 18*a-d* which are similar to FIGS. 12 and 13, with sectional views 18*c* and 18*d* taken at the same level as in the aforementioned diagrams.

Figure 18A:
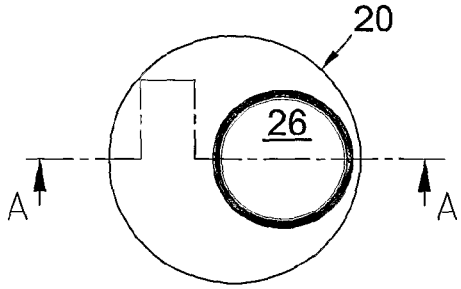
FIG. 18*a* shows a top view of the completion suspension valve in the valve override open position.
Figure 18C:
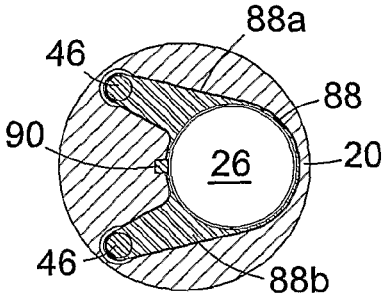
FIGS. 18*c* and *d* are respective cross-sectional views taken on the lines B-B and C-C of FIG. 18*b;*
Figure 18D:
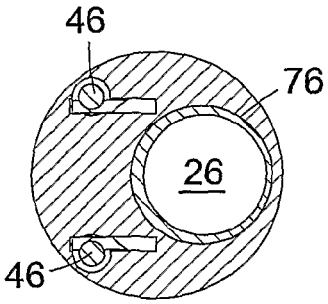
FIG. 18*b* is a longitudinal sectional view taken on the lines A-A of FIG. 18*a;*
Figure 18B:
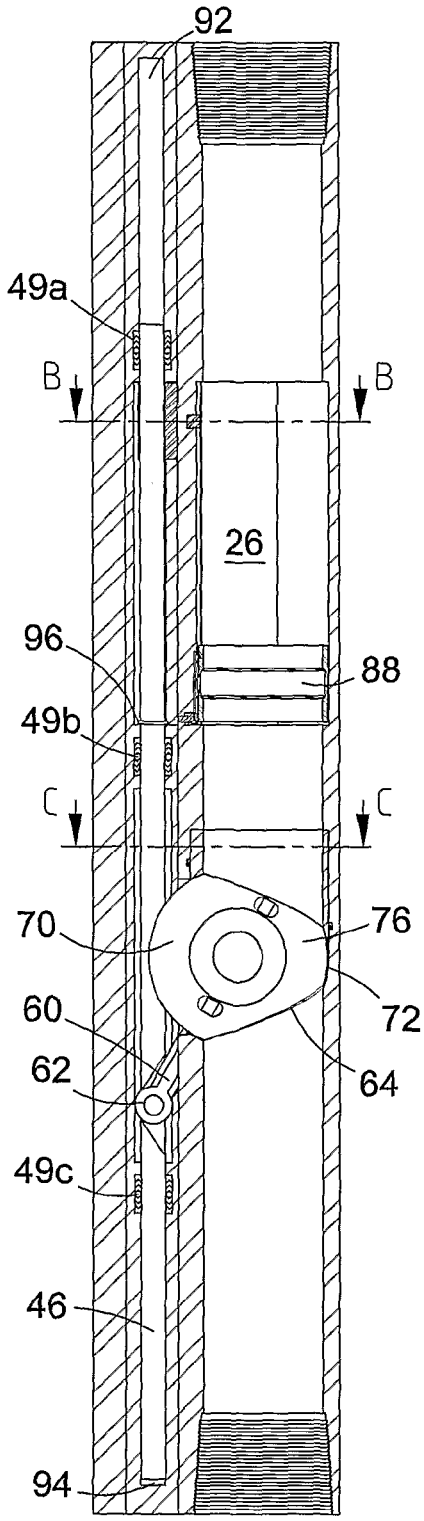

It will be seen that the nipple legs 88*a*,88*b* contact the annular land around the guide shafts and consequently the guide shafts are also moved downwards to the position shown in FIGS. 11*c* and 18*d*.

Figure 19:
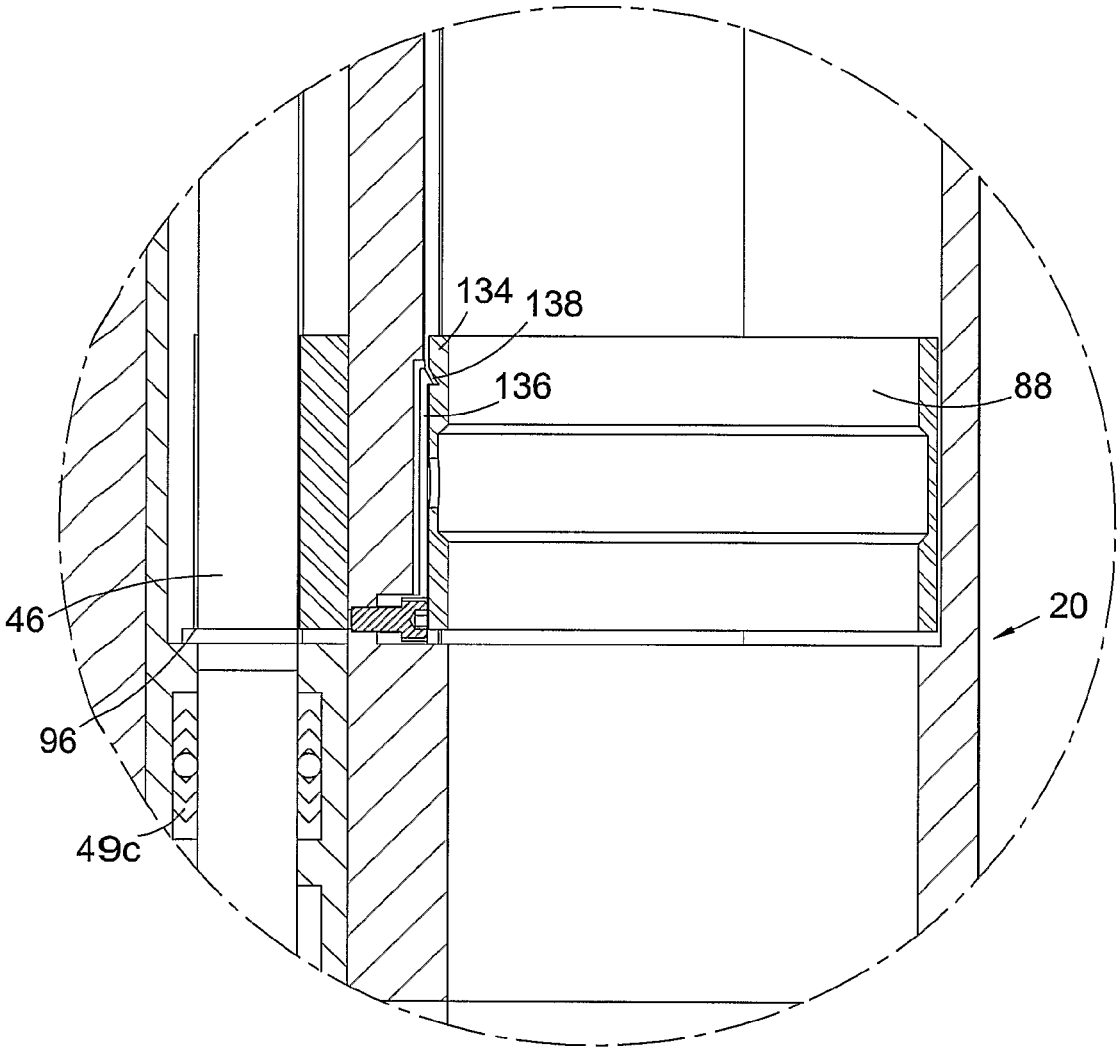
FIG. 19 is a view similar to FIG. 17 but with the nipple in the overridden position and engaged with a detent finger to lock the valve in the open position.

Reference is also made to FIG. 19 of the drawings which is a similar view to FIG. 17.

As best seen in FIG. 17 it will be seen that the outside surface of the nipple 88 has a notch 134 for receiving a detent finger 136 (FIG. 19) which is located in the valve housing 20 at the position shown when the nipple 88 is at its lowermost position. In this position, as shown in FIG. 19, the notch 134 is engaged with an upper angled face 138 of the detent finger 136. The detent finger is resiliently biased so that it exerts force to retain it in the position shown in FIG. 19. It will be appreciated that the upper end of the detent finger and its corresponding groove are shaped like a barb and once the finger 136 engages with the nipple 88 and is resiliently retained in this lowermost position, the ball valve element is maintained in the open position and this position is known as the overridden open position.

The override tool 110 then retracts the piston 108 and this will initially retract the mandrel 114 and desupport the spring-loaded dogs 120. Further retraction of the piston 108 develops sufficient force to cause the dogs 120 to collapse into the windows 122 due to the angled mandrel surface 124 at the top of the nipple groove. Once the dogs 120 are collapsed, the override tool 110 is free to disengage with the nipple 88 which is then retained in the downward position shown in FIG. 20 by the detent finger 136. The piston 108 may be retracted and the appropriate xmas tree functions performed and the override package 108 may then be retrieved.

Figure 20:
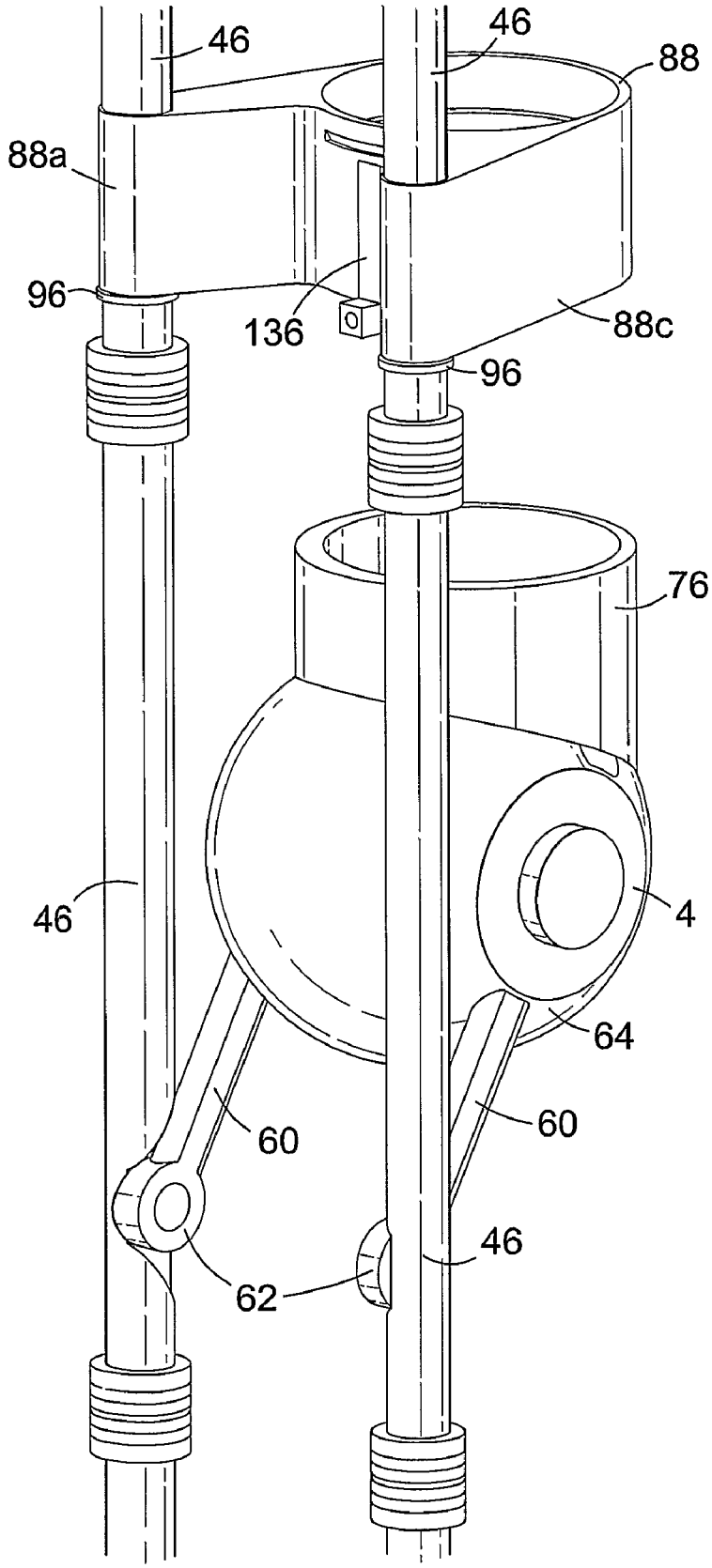
FIG. 20 is a perspective view with the main body removed showing the completion suspension valve in the overridden position with the ball element held open and abutting the offset valve seat and the override nipple shown abutting shoulders on the suspension valve guide shafts.

FIG. 20 is a partly broken away and perspective view showing the completion suspension valve 22 in the overridden position with the offset ball element 64 held open and abutting the offset valve seat 76 with the override nipple 88 shown abutting the annular shoulders on the suspension valve guide shafts 46 and the detent finger 136 showing engaged with the notch 134 in the override nipple 88.

It will be understood by those of ordinary skill in the art that an efficiently packaged valve arrangement such as that described above with reference to the completion suspension valve has further applications. For example, FIGS. 21 to 23 illustrate such applications.

Figure 21:
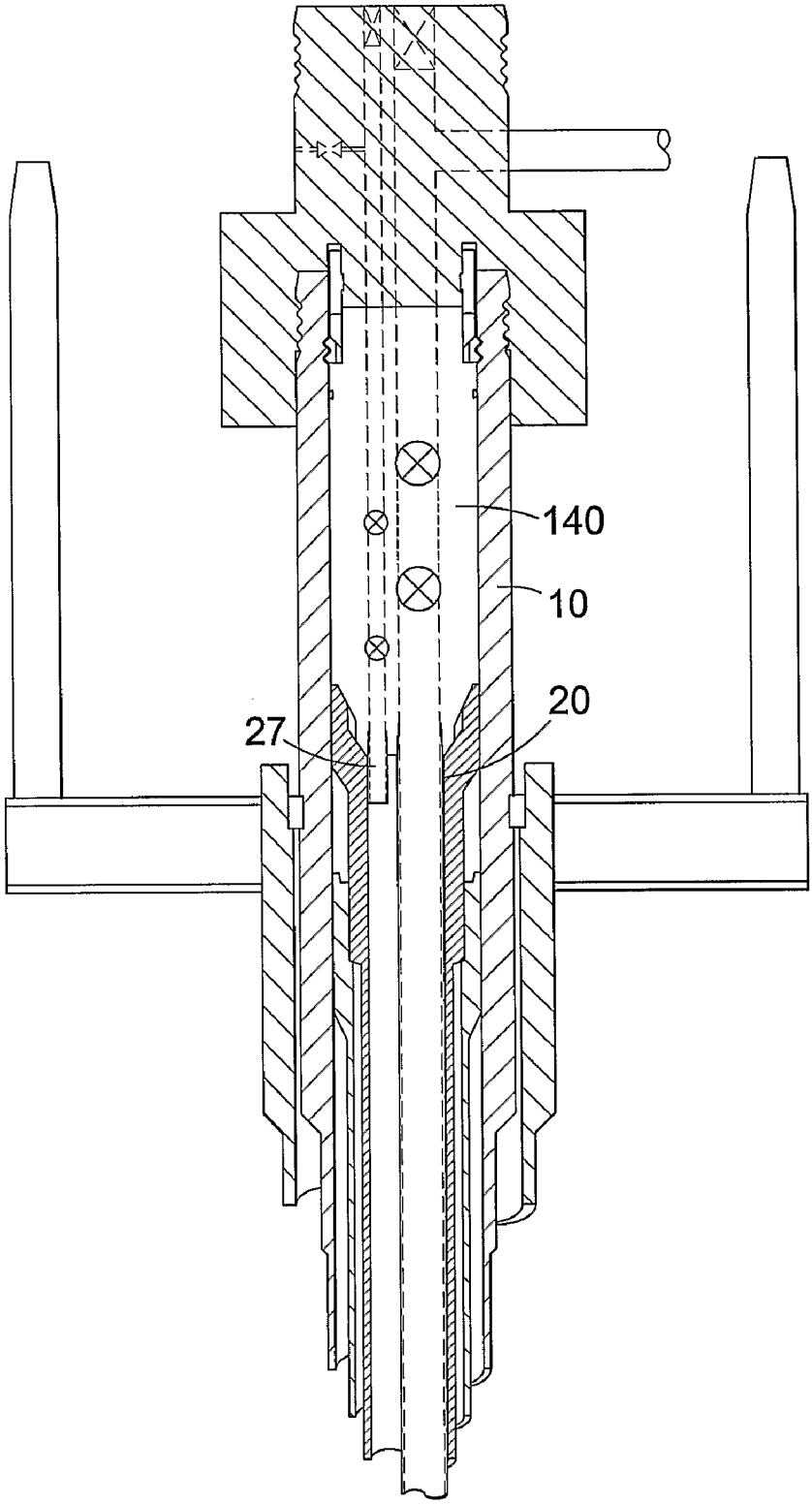
FIG. 21 is a diagrammatic view of an alternative application of the completion suspension valve in an in-line tree where the valve system is disposed within the wellhead.

Firstly with reference to FIG. 21 this shows the application of the completion suspension valve to an in line tree. In this particular application, a valved tubing hanger 140 is provided within a wellhead 10. Like numerals refer to like parts as described above with reference to FIGS. 1 to 20. Thus, it will be appreciated that the valves and actuators within the valve tubing hanger located inside the envelope of the wellhead bore and this arrangement is enabled via the use of a contact arrangement of components such as the completion suspension valve.

Figure 22:
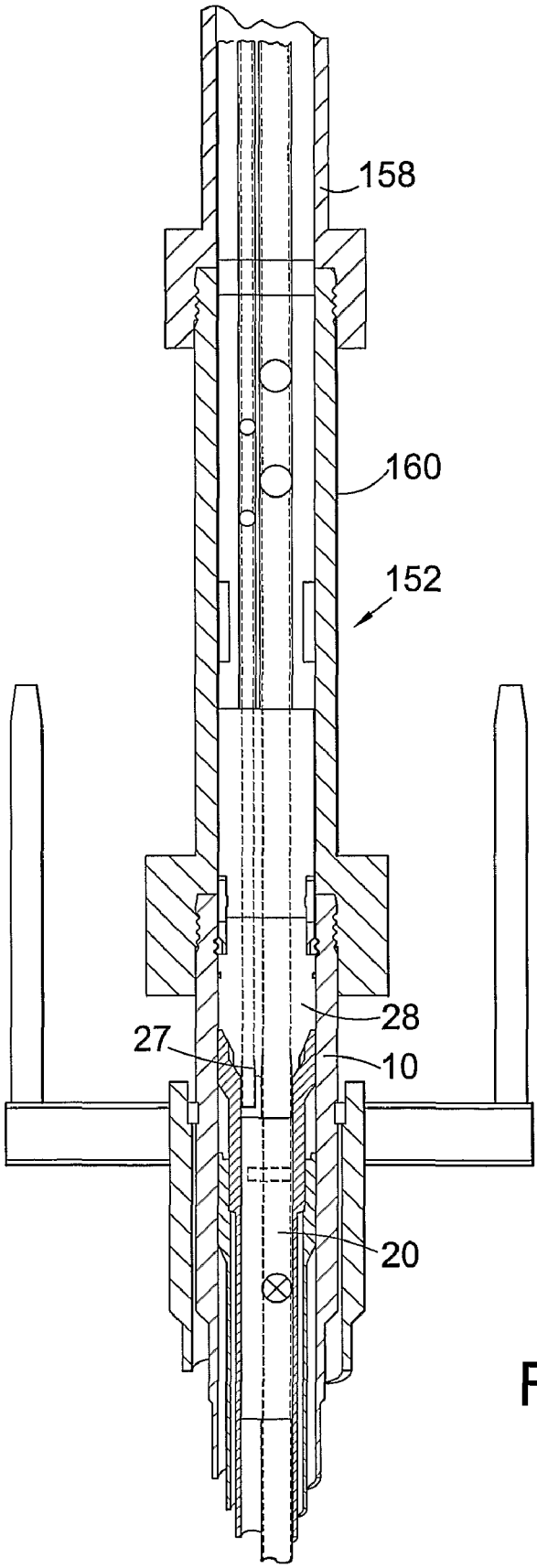
FIG. 22 is a further diagrammatic view of a further alternative application of the completion suspension valve incorporated in a sub-sea test tree.
Figure 23:
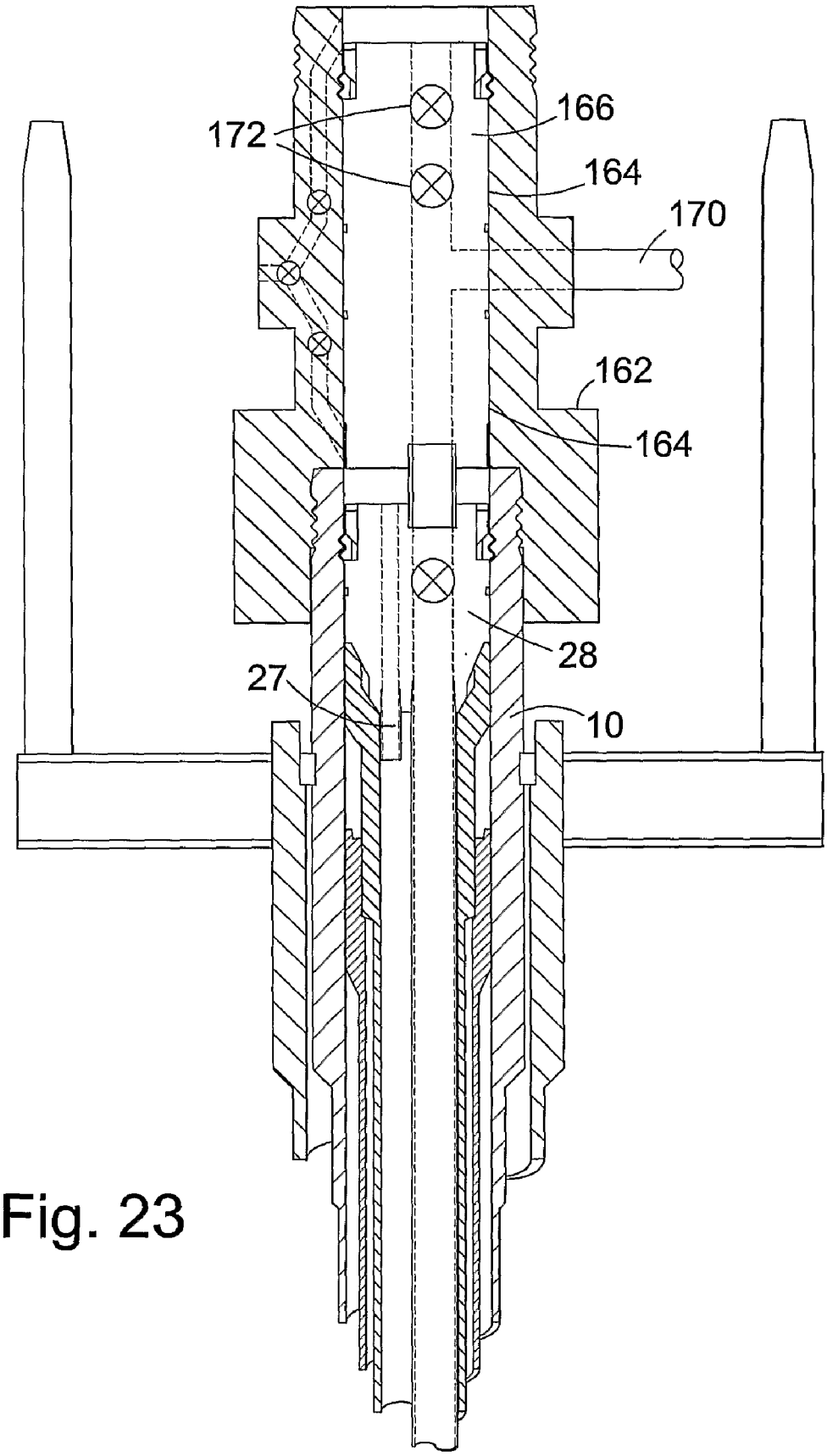
FIG. 23 depicts a further application of a completion suspension valve in accordance with the invention incorporated into an insert tree with the completion suspension valve being shown coupled to the wellhead.

Reference is now made to FIG. 22 which depicts the application of a completion suspension valve in a subsea installation tree, generally indicated by reference numeral 152. It will be appreciated that the valves may be suitable for use in a 5"×2" dual bore subsea installation tree (Expro North Sea Limited). The dual bore subsea tree provides both 2" annulus valves and 5" production bore valves in the annulus bore 27 and production bore 20 respectively and actuators within the envelope defined by the bore of the marine riser 158 and the BOP 160.

A further application of the completion suspension valve described above is depicted in FIG. 23 where it is used for a hybrid tree insert. In a conventional or dual bore system, the tubing hanger is landed and locked to the wellhead. The xmas tree is subsequently landed on top of the hanger which implies that the tree must be removed prior to the retrieval of the tubing hanger.

In contrast, in a horizontal system the xmas tree is established onto the wellhead and the tubing hanger subsequently landed on a shoulder inside the tree. This implies that the hanger and tubing must be retrieved prior to retrieving the tree.

In a further arrangement, as best seen in FIG. 23, the hanger 28 is run through the wellhead 10 and locked thereto. A tree 162 with a bore 164 large enough to allow through passage of the hanger 28 is then run and established onto the wellhead 10. A valved insert 166 is located within the bore 164 and the insert 166 with the tubing hanger 28 serves to divert flow from the hanger 28 into the tree outlet 170. It is convenient if the insert 166 utilises valves 172 to divert the flow and these valves 172 occur in the restricted envelope defined by the tree bore 164 and the valve function is fulfilled by the valve arrangement outlined as described above.

Figure 24:
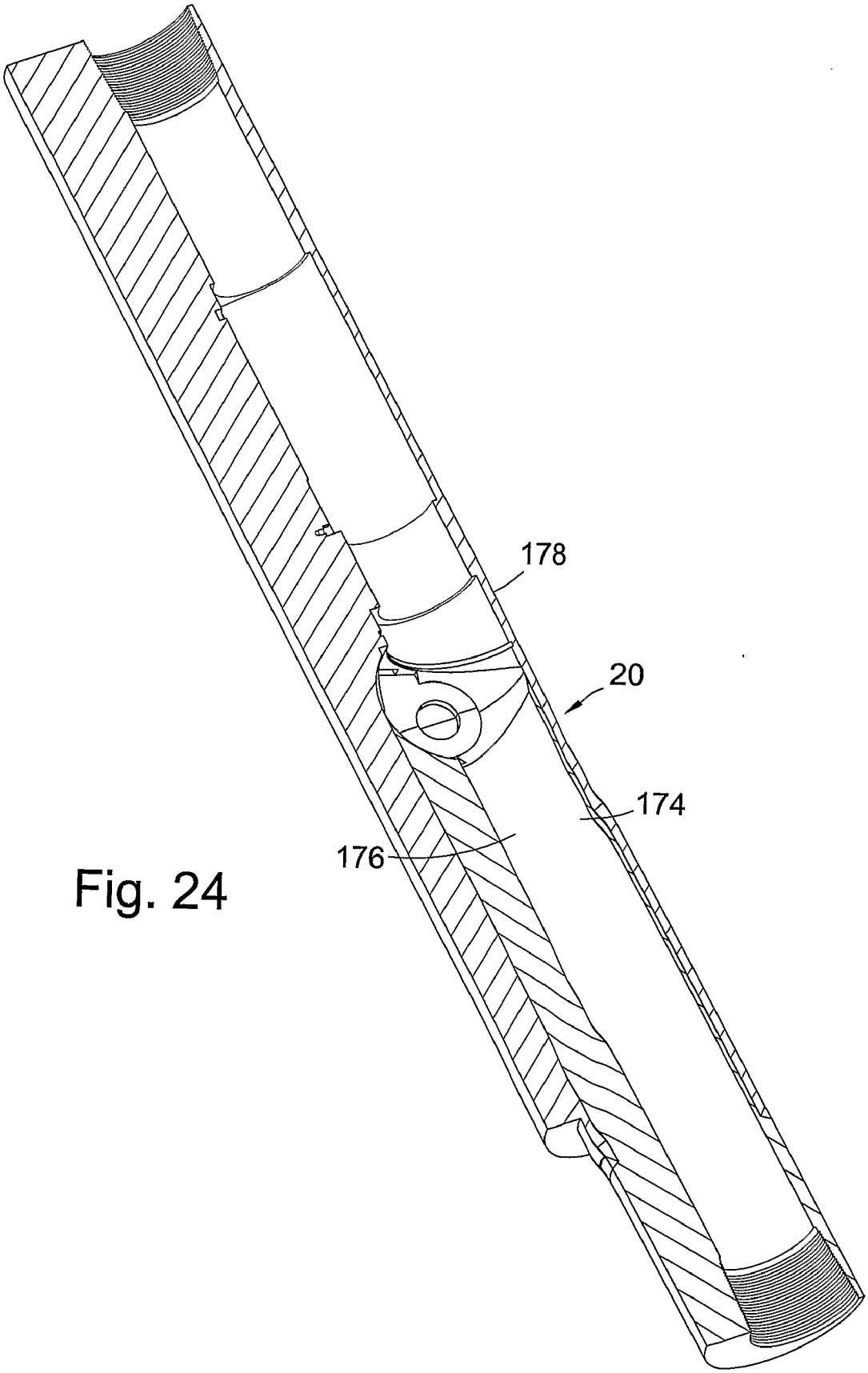
FIG. 24 depicts part of a completion suspension valve in accordance with the invention which is used to manufacture the completion suspension valve, view depicting a main body and a lower body which are welded together to permit assembly.

Reference is now made to FIG. 24 of the drawings which is a longitudinal sectional view through part of the main body of a completion suspension valve housing in accordance with a preferred embodiment of the invention and depicting how the completion suspension valve sub may be assembled in accordance with the preferred embodiment. In this arrangement, the main body 20 provides a large axis bore 174 between its bottom face 176 and its ball cavity 178. The seat seal, ball seat, apertured ball element and actuation valve may be inserted through the large axis bore. The lower body engages with trunnion mechanisms which support and locate the ball element. The main body and the lower body include weld preparations which allow a circumferential weld to be performed. The weld is about ⅙th of the distance from the bottom, at about 5-10 cms before the body widens to its full diameter, thereby unitising the main and lower bodies permanently. It will be understood by a person of ordinary skill in the art that a low heat process such as electro beam welding is preferred to avoid risk of damage to heat sensitive components. Referring also to FIG. 10, it will be seen that the guide shafts are assembled within the valve housing by removing access cap 176 which sealingly engages with the valve body 20. A thread 178 and the outside diameter of the cap 176 engages with a thread 180 at the top of the body 20. The guide bar 46 is installed into the guide bore 47 within the body 20. A closed chamber is thereby formed around the guide bar. The hydraulic control port 48 communicates with the upper end of the body as described before such that hydraulic fluid is supplied into the closed chamber and, as also described above, a similar arrangement occurs at the lower end of the body to enable the valve closed chamber to be formed.

Figure 25A:
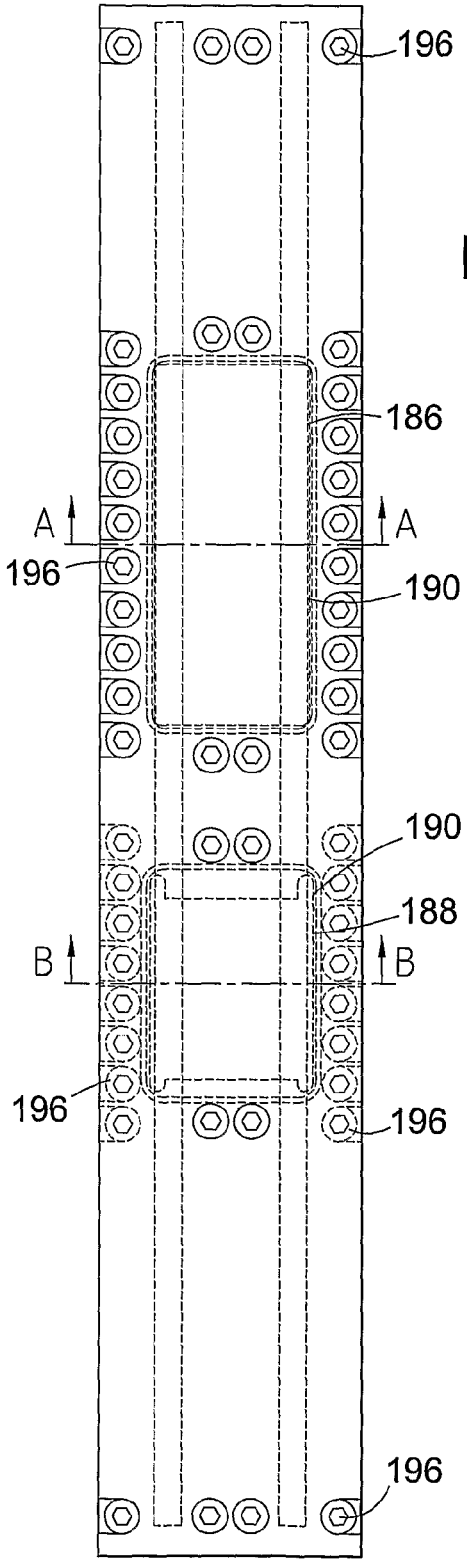
FIGS. 25*a, b* and *c* depict longitudinal sectional and cross-sectional views on lines A-A and B-B respectively of a two-piece main body which is assembled together to form a completion suspension valve in accordance with an alternative embodiment of manufacture in accordance with the present invention.
Figure 25B:
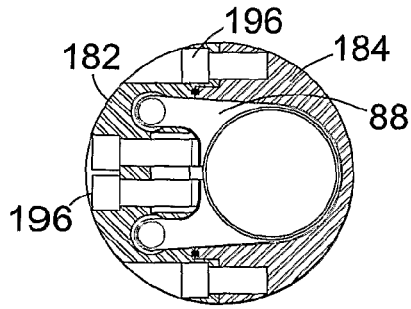
Figure 25C:
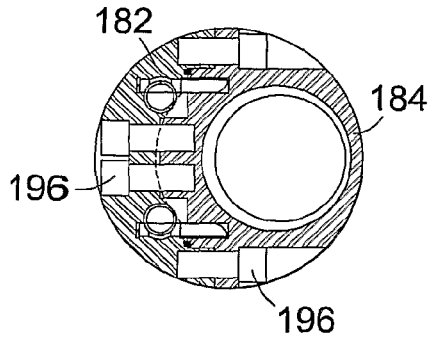

An alternative arrangement of assembling a completion suspension valve is hereinbefore described with reference to FIGS. 1 to 20 is depicted in FIG. 25*a, b* and *c* of the drawings. FIGS. 26*a, b* and *c* illustrate a two-piece main body 182,184 with the body being split down a vertical plane with two large access windows 186,188 machined into one half. The offset ball element and offset ball seat are installed through the lower window 188 and the override nipple 88 is installed through the upper window 186. The guide rods 46 are installed in the remaining body half and a gasket or seal 190 is fitted round the periphery of each window. The two body halves 182,184 are then brought together and the windows 186,188 are then covered and sealed. An array of cap screws 196 are installed around each window and at the top and bottom of the body providing a closure with sufficient strength to resist the separate forces developed by fluid pressures within the completion suspension valve.

Figure 26:
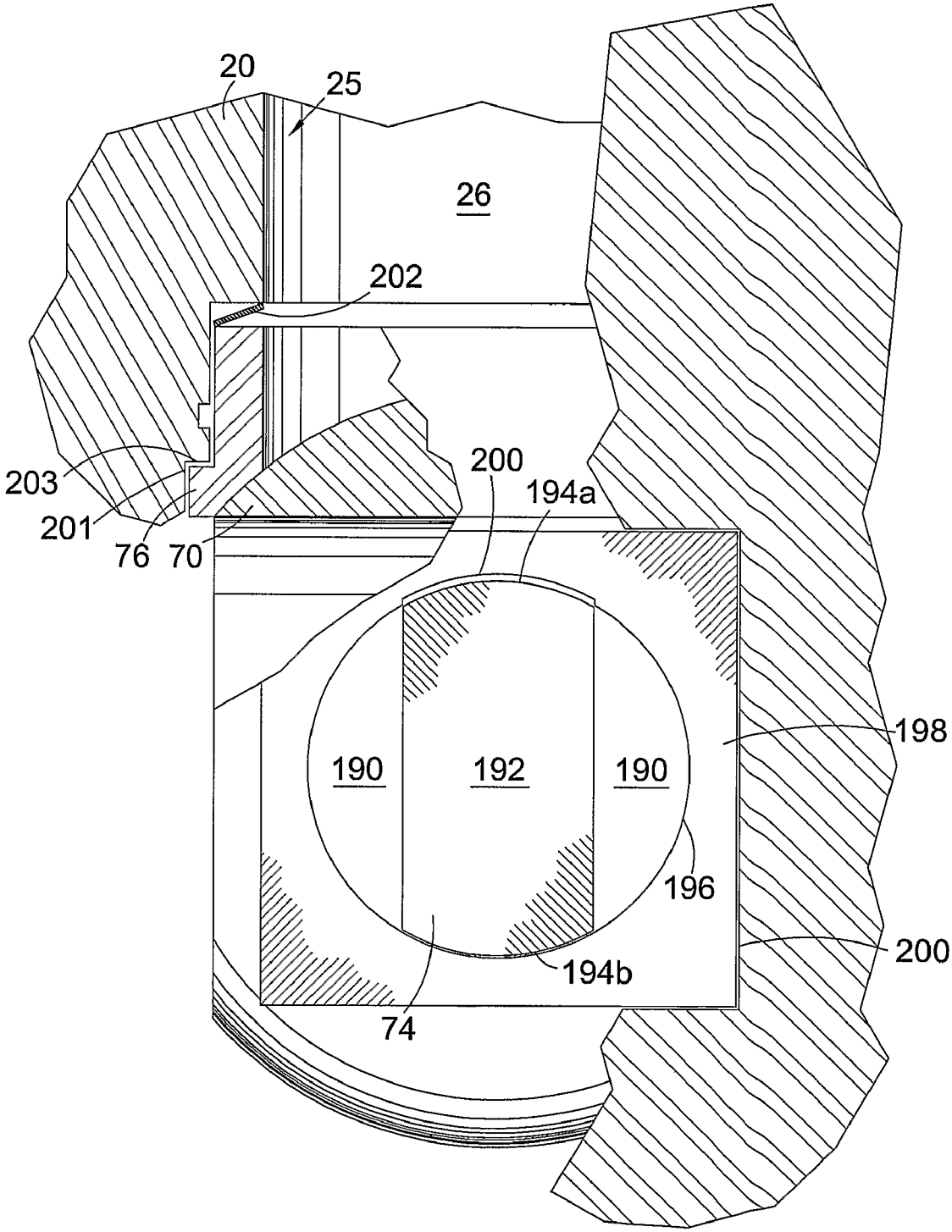
FIG. 26 is an enlarged sectional side view of part of the ball element and bearing element used for mounting the ball within the completion housing to permit the ball to be held unloaded from the seat during rotation and which is then allowed to float on the seat for sealing.

Reference is now made to FIG. 26 of the drawings which depicts an enlarged sectional side view of part of the ball element and bearing element used for mounting the ball within the completion suspension valve housing to permit the ball to be held unloaded from the seat during rotation and which is then allowed to float on the valve seat for sealing.

It will be understood that the increased torque delivered by the bar rotation mechanism is desirable as it increases operating reliability. Similarly, reliability can be enhanced by reducing friction losses encountered during rotation of the ball. This is achieveable by ensuring that the ball rotates by virtue of its trunnions engaging with bearings and not by virtue of the sphere of the ball engaging with the partial hemispherical surface of the valve seat. Ensuring that constant rotational constraints are caused at the smallest radius possible, ensures that such frictional forces or losses are minimised.

During rotation of the ball it is desirable that its position is fixed and determined by the bearing position. Accordingly, the valve seat may be tentatively pushed on top of the ball by a small spring to maintain contact and prevent ingress of debris between the sealing surfaces of the ball and seat. Frictional losses arising from such contact are always in proportion to the very small force exerted by the spring and are constantly considered to be negligible.

However, in the closed condition, the contact between the ball and valve seat is only sufficient to contain a very small differential across the valve element. It is desirable therefore that the contact force between the ball and valve seat increase in response to an increase in differential pressure to maintain a contact force in proportion to the prevailing differential pressure and resulting in higher sealing reliability of the valve.

The arrangement shown in FIG. 26 permits this to be achieved when in the closed condition, so that bearings on which the ball is located are allowed to move upwards either in the presence of a differential or when the ball is fully in the closed position. This solution is achieved by allowing the ball to float upwards by machining the trunnion 74 so that it is no longer a complete cylindrical extrusion emanating from each side of the ball. As shown in FIG. 26, areas of the trunnion 190 have bee machined away from either side leaving only a central portion 192. Both trunnions 74 are machined in this way and effectively this leaves each trunnion with its circular surface divided into two curved parts 194*a,b*. Surfaces 194*a,b* engage with the bore 196 of a plane bearing 198. Plane bearing 198 is mounted on a pocket 200 cut into the inside surface 25 of the valve body 200 and thus when the circular portions 194*a,b* of the ball trunnion 192 are engaged with the bore 196 of the bearing, the position of the ball element relative to the valve body is fixed.

It will be understood that this relationship is only operational as long as the ball is not in the closed position. When the ball is rotated to the fully closed position, the trunnion bearing upper surface 194*a* is adjacent to a rebate 200 in the bore 196 of the plane bearing. A differential pressure applied from below across the valve results in ball 64 following the seat 76. The ability of the ball to move allows the contact force between the ball and seat to intensify in proportion to the prevailing differential pressure, thus ensuring that high sealing integrity is achieved. Axial seat travel is limited by a shoulder 201 which contact the top of a pocket 203 in the body bore. The amount of ball float always exceeds the available seat travel to ensure that a compressive load is maintained.

As differential pressure is removed, the corresponding pressure force it exerts on ball and seat system decreases. When this force decreases to a value less than that exerted by a seat spring 202, the spring 202 pushes the seat 76 and ball 64 downwards until the trunnion load bearing face 194*b* contacts the bore 196 of the plane bearing. In this position the ball is once again ready to be rotated to the open condition and the position of the ball is once more fixed relative to the valve body.

Embodiments of the invention also permit the valve to be overridden to the open position and furthermore the overriding means do not require a rigid riser to the surface. The use of the offset bore allows the provision of a ball valve within a confined space and differential thickness on either side of the valve allows the ball to accommodate an increase in the differential capacity of the valve for a given sphere and bore size.

Furthermore, offsetting the bore allows a larger outside diameter of seat to be accommodated so that a greater area of contact is offered to the ball via the partial hemispherical face. In addition, the use of a seat seal groove when used in conjunction with the eccentric bore seat maximises the bore size and differential capacity for a given bore offset and body diameter and the use of the incline bore allows the thin portion of the seat to be supported from the presence of the ball.

In the case of the apertured ball valve embodiment, the use of the sliding actuation bars permits relative rotation of the movement between the mechanism and the bars with the result that a torque can be developed which is further from the ball centre resulting in higher torques and higher reliability of movement.

Further reliability is enhanced by further reducing frictional losses encountered during rotation of the ball by using a floating ball element to maintain a contact force in proportion to the prevailing differential pressure which results in higher sealing reliability of the valve by ensuring that a compressive load is always maintained with the amount of ball float exceeding the available seat travel.

In the foregoing description it will be understood by those of skill in the art that an annulus bore and annulus valve is provided on each of the embodiments and that operation of the annulus valve is performed using existing well known annular valve control techniques.

A further modification to the embodiments of the invention described above is shown in FIGS. 27 to 33. It has been described above how the provision of a valve in the production bore of the tubing hanger is beneficial. It will be understood by those of ordinary skill in the art that many wellhead equipment manufacturers already posses concepts and solutions for the provision of a remotely operable barrier in the annulus bore of the tubing hanger. The completion suspension valve invention already described could be used in conjunction with such an "annulus valved hanger". This would provide a system in which remotely controllable barriers occurred in both the production and annulus bores and is a configuration for facilitating the trees-on-wire deployment philosophy, previously outlined.

One implication of the configuration outlined above is that each valve is manipulated by a dedicated actuator each of which, in turn, is served by both open and close lines. It will be understood that the space available to accommodate these actuators, ports and interfaces is limited and it may be extremely difficult to include all the necessary features within the given envelope. Further the provision of multiple actuators with their associated control lines creates an increasing quantity of penetrations through the hanger body. It is generally accepted that in the interests of simplicity and reliability that the number of penetrations through the hanger should be kept to an absolute minimum because each penetration is perceived as a potential leak path.

With a further reconfiguration of the completion suspension valve actuator described, a system is provided whereby a single actuator provides simultaneous control to both the production valve and an annulus valve. This minimises the quantity of actuators required to one and also minimises the control line requirements to two (one open and one close). With this approach it becomes significantly easier to provide both annulus and production bore valves within the confined envelope already described. By adopting this approach a further benefit is enabled which will now be described.

The importance of providing a means to override the suspension valve 22 has already been described above. In the embodiment previously described, a nipple 88 attached to the actuator rod 46 was provided which was manipulated by a hydraulic ram 110. Whilst this is an adequate solution, an alternative, simpler method of override is described in this embodiment which will be described in more detail later.

There now follows a description of the valve with reference to FIGS. 27-33. The production bore valve closure elements, their location and method of rotation are all as previously described and like numerals refer to like parts but with the suffix 'a' added. The main difference arises in relation to the actuator rod.

Figure 27:
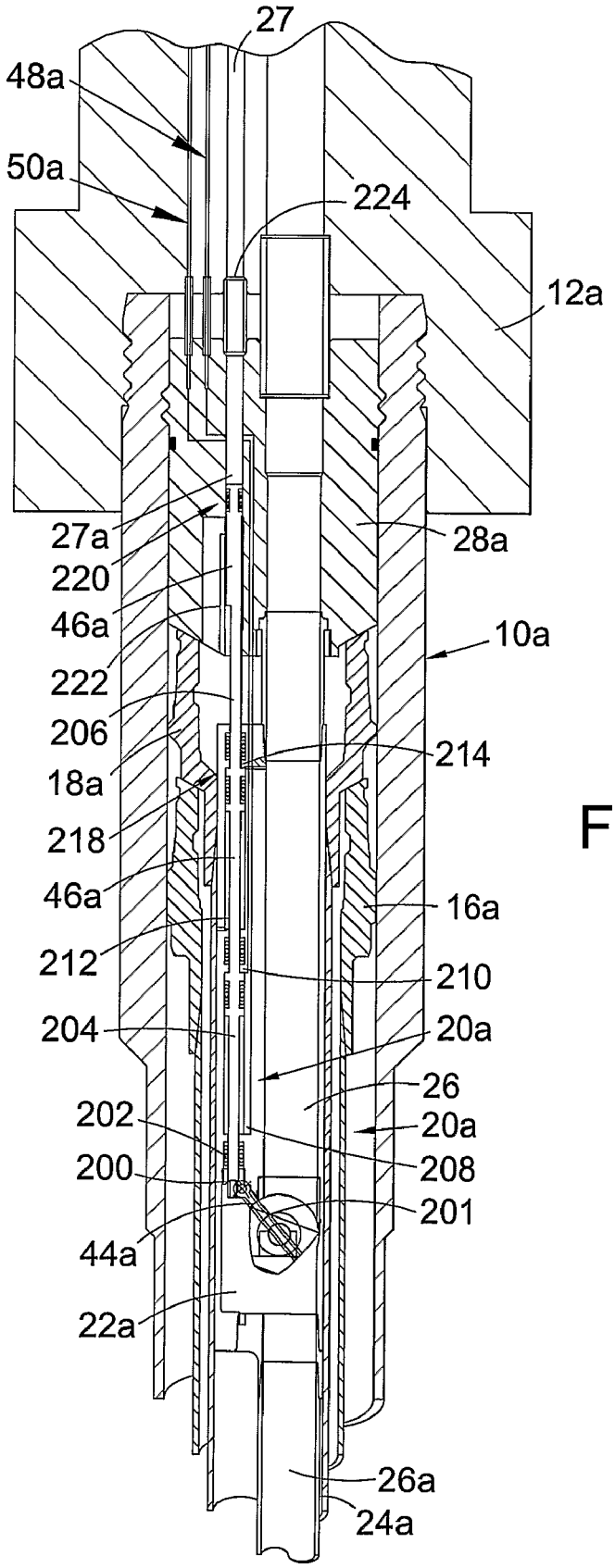
FIG. 27 is a longitudinal sectional view through a completion suspension valve housing with the valve closed in accordance with an alternative embodiment with a xmas tree attached to the wellhead.

Firstly, with reference to FIG. 27, the lowermost portion of a single actuator rod 46*a* connects to a yoke 200 which is in turn connected to the two rotation bars 201, one of which is shown. This actuator rod 46*a* is sealed at its lower end to the valve body via a v-type packing 202. Above this the rod 46*a* provides two piston portions 204,206. The lower of these 204 is the actuation portion, comprising the close chamber 208 and open chamber 210 to which control fluid is supplied via lines 48*a*,50*a* respectively and vented to cause cycling of the valve 22*a*. The upper piston 206 is an equalising piston with a lower chamber 212 ported to the annulus 27*a* and the upper chamber 214 ported to the production bore 26*a*. These upper and lower piston systems are separated by a seal 216, again of the v-packing type. The actuator stem 46*a* exits the main body 20*a* of the production valve assembly via a further v-packing seal 218. The actuation rod continues upwards to interface with the annulus bore 27*a* in the tubing hanger 28*a* via a final v-packing seal 220.

A side port 222 which communicates with the well annulus 27*a* intersects with the annulus bore in the tubing hanger 28*a*. The position of the latter, uppermost v-packing 220 relative to this side port 222 indicates whether the annulus bore 27*a* is closed or open. When the actuator rod 46*a* is in its uppermost position, the v-packing 220 sealingly interfaces the annulus bore 27*a* above the side port 222. This effectively closes the annulus bore 27*a*. When the actuator rod 46*a* is in its lowermost position the v-packing 222 sealingly engages the annulus bore 27*a* below the side port 220 (FIG. 32*b*). This means that the annulus may be considered open. Under normal operation of the actuator rod 46*a* therefore the v-packing 220 may be considered to be acting as a "valve" and may be referred to as such in the following text.

Figure 28:
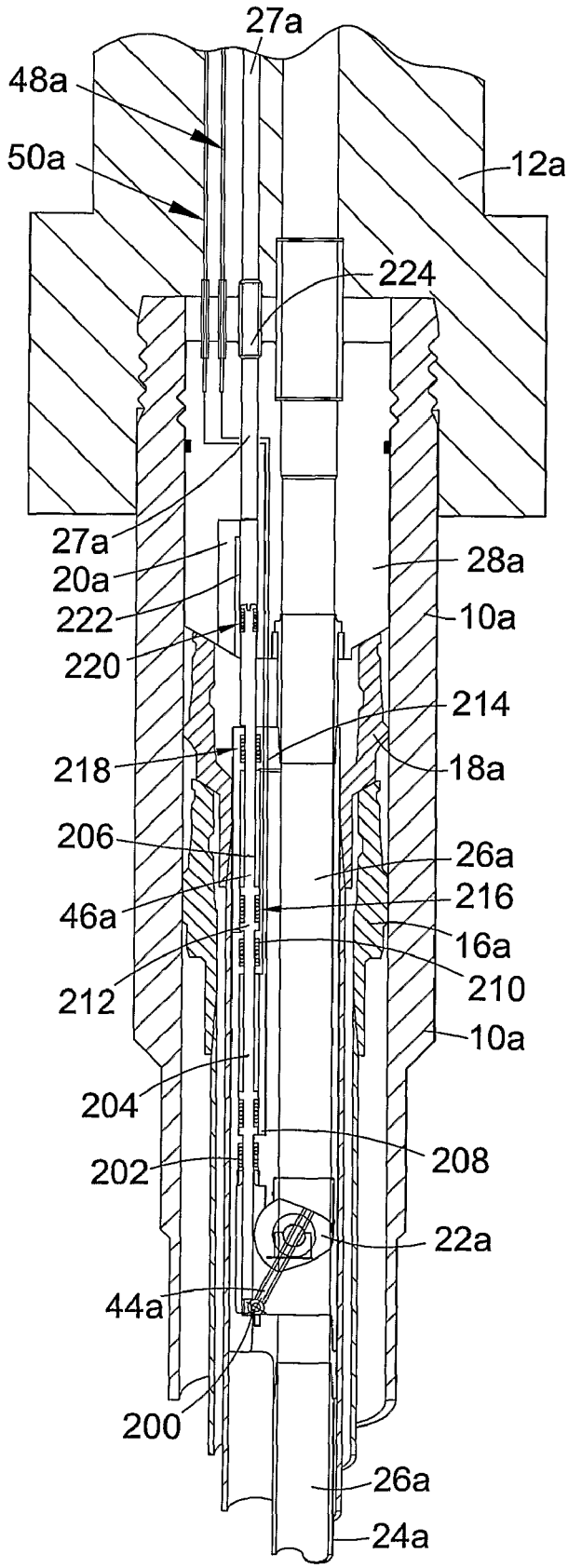
FIG. 28 is a view similar to FIG. 27 but with the valve in the open condition.
Figure 29:
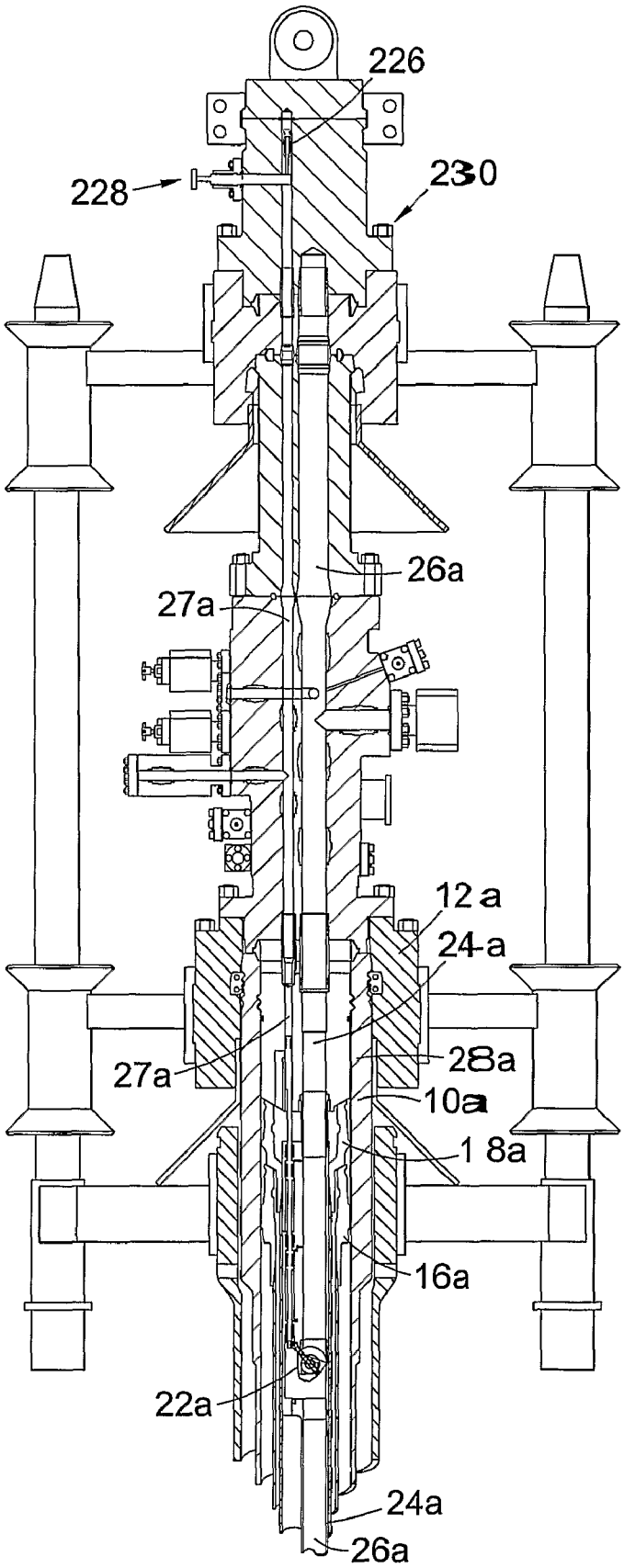
FIG. 29 is a view of the suspension valve assembly shown in FIG. 1 shown with a complete xmas tree and lower user package connected to the wellhead.

FIG. 28 shows the valve 22*a* in the open position. This position is achieved when normal actuation is performed via the hydraulic lines 48*a*,50*a* as outlined previously i.e. to open, pressure is applied into the open line 50*a* and pressure is vented from the close line 48*a*. This causes the actuation rod 46*a* to move downwards. The production bore valve 22*a* is rotated as previously described to the closed position shown. In the annulus bore 27*a* the uppermost v-packing 220 is translated from a position above a side outlet (FIG. 27) to a position below said side outlet 222. In this lowermost position a fluid path is established between the well annulus 27*a* and its corresponding outlet 224 on the top face of the hanger 28*a*. Closure of both the production and annulus bores 24*a*,27*a* is the reverse of the aforementioned process.

The presence of the actuator rod 46*a* in the annulus bore 27*a* now conveniently accommodates an alternative method of override. Inspection of FIGS. 27 and 28 reveals that the override nipple 88 present in the initial embodiment has been omitted in this embodiment. Override is instead performed by dropping a sealing override plug 226 down the annulus bore onto the top of the actuator rod and pressuring it downwards. There now follows an illustrative sequence of events best described with reference to FIG. 29.

The tubing hanger 28*a* is installed and locked and tested. The production and annulus valves are closed. The xmas tree 12*a* has been deployed and locked onto the wellhead 10*a* and the appropriate testing conducted. The production, annulus and control stabs have been established between the xmas tree 12*a* and the hanger 28*a*. An unsuccessful attempt is now made to open the tubing hanger valves 22*a*. The valve 22*a* now requires opening by another means or, in other words, overriding.

Figure 30:
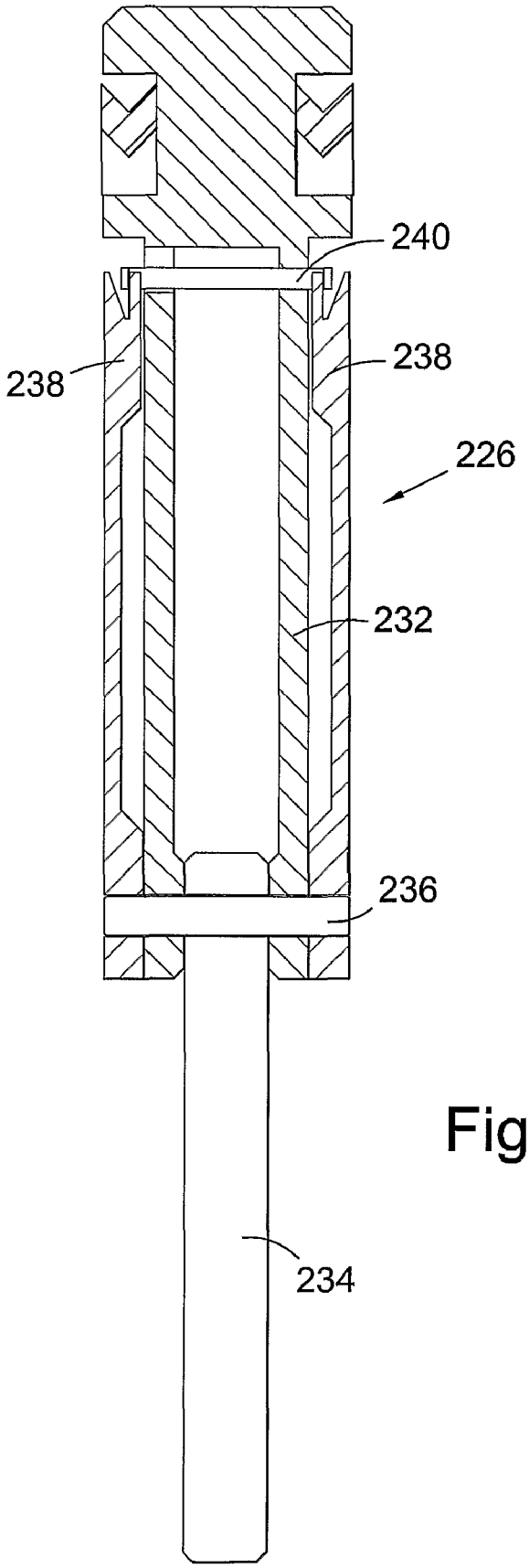
FIG. 30 is an enlarged view of an override plug shown in FIG. 1 for maintaining the suspension valve in a fully open position.
Figure 31A:
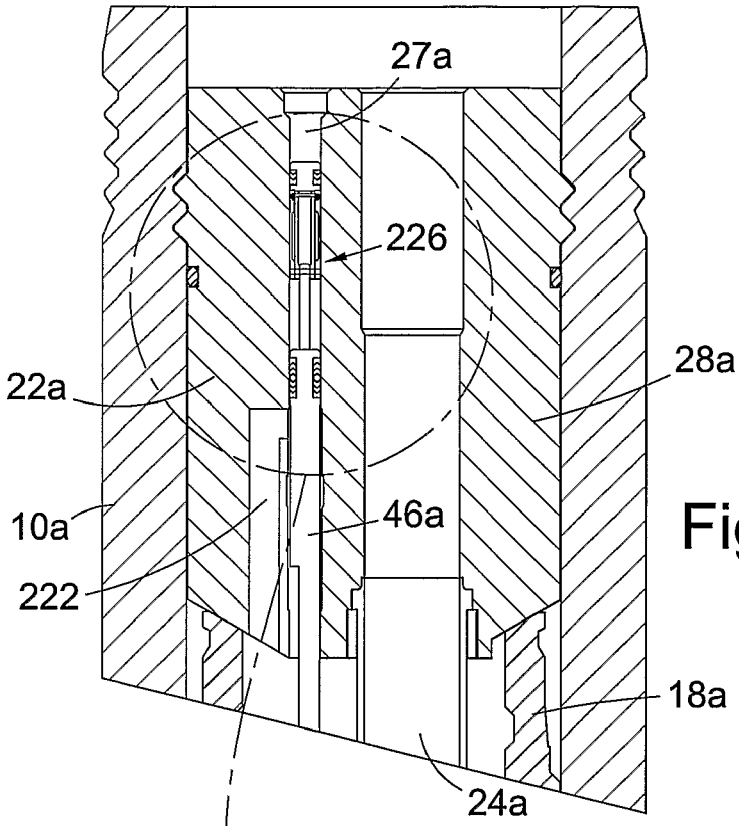
FIGS. 31*a,b* are longitudinal sectional views (31*b* being an enlarged detail) of the plug of FIG. 29 shown disposed in the annulus bore above the actuator rod.
Figure 31B:
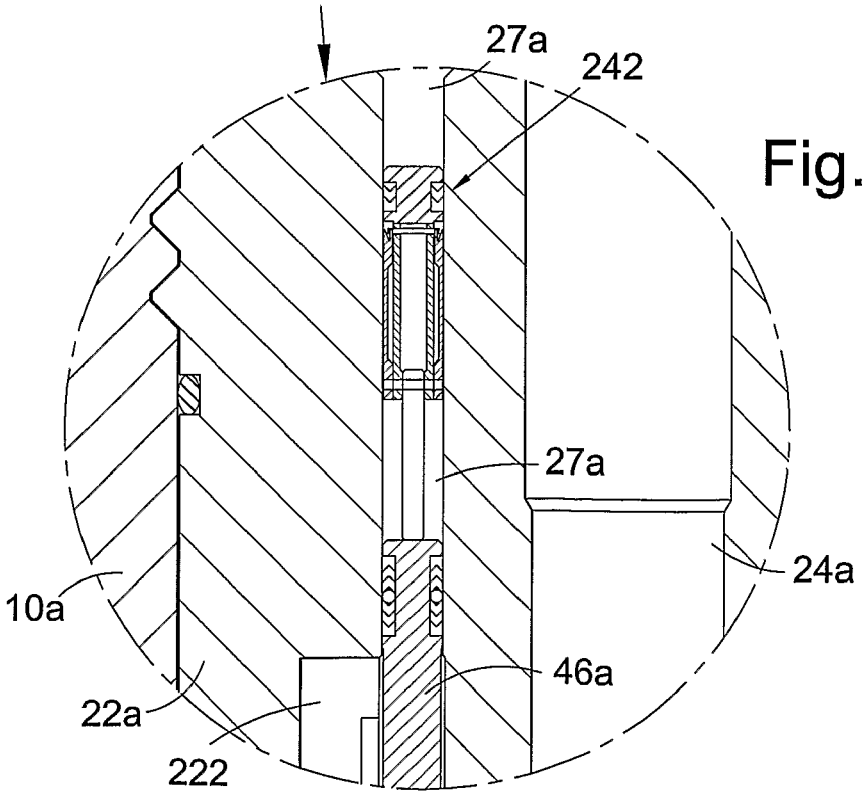

Override operations commence with an ROV (remotely operated vehicle) (not shown in the interest of clarity) pulling a selector handle 228 at the top end of the xmas tree running tool 230. This releases the override plug 226 which falls down the annulus bore 27*a* until it contacts the upper end of the actuator rod, as shown in FIGS. 31*a*,31*b*. The override plug is shown in FIG. 30; it is generally elongate and has an upper tubular housing 232 coupled to a lower plug pin 234 by a shear pin 236. Spring-loaded detent fingers 238 are retained against the housing wall by a retaining ring 240. At the top of the housing a V seal stack 242 is located. Pressure is now applied into the annulus bore 22*a* above the plug 226 which results in downwards movement both of the plug 226 and actuator rod 46*a*. The pressure can be supplied either from an installation umbilical which terminates in the tree running tool or the power may be provided by the ROV which may dock with the tree running tool. Pressure continues to be applied until the actuation rod 46*a* is displaced to its lowermost condition, as shown in FIGS. 32*a* and *b*, at which point both valves are open and the actuation rod 46*a* endstops.

Figure 32A:
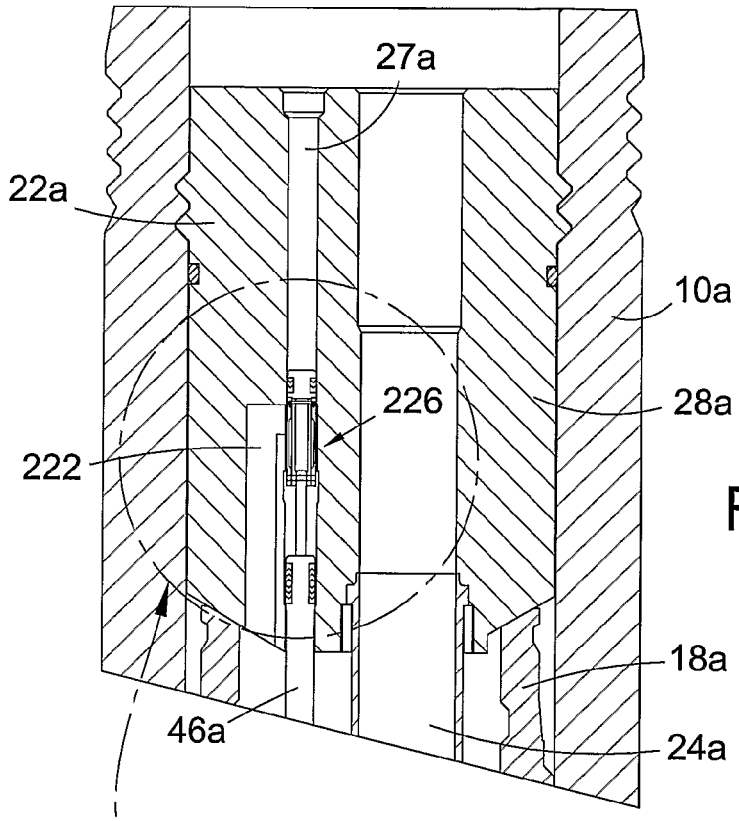
FIGS. 32*a,b* are similar views to FIGS. 31*a,b* with the override plug and actuation rods displaced downwardly in the annulus bore by pressure.
Figure 32B:
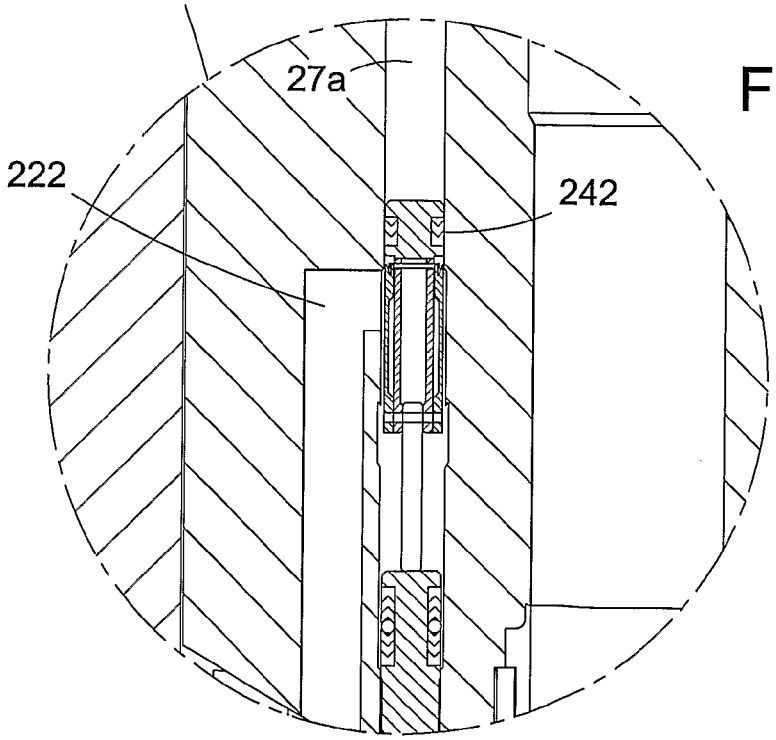
Figure 33A:
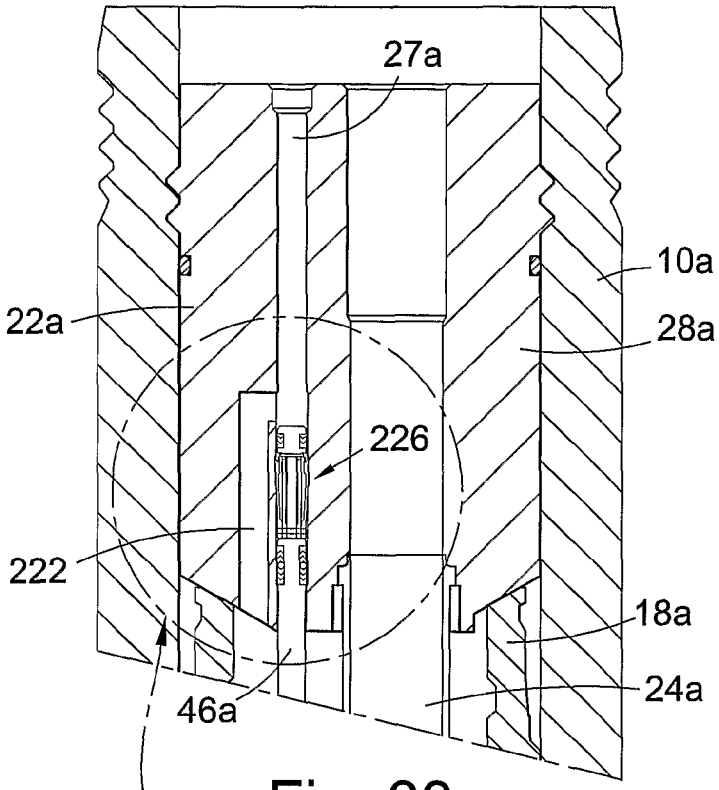
FIGS. 33*a,b* are views similar to FIGS. 32*a,b* and depicting further downward displacement of the upper end of the override plug to secure the plug in the annulus bore and to retain both annulus and production bores in the open position.
Figure 33B:
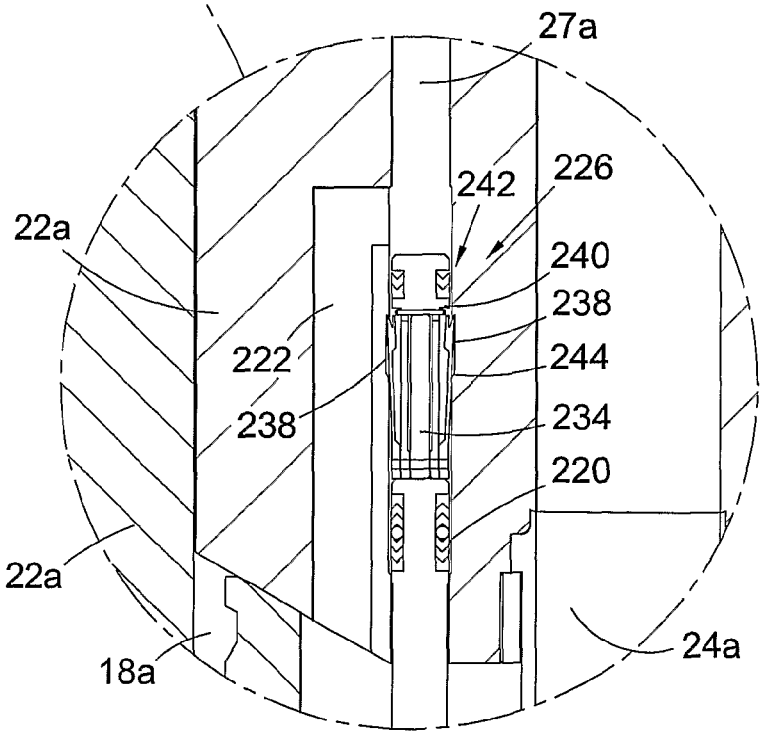

In FIG. 32*a,b* the seal stack 242 of the override plug 226 remains above the side outlet 222 of the annulus bore 27*a*, keeping said bore effectively sealed. Pressure is further increased above the override plug seal stack 242 with the lower end of plug pin 234 abutting the endstoppped actuation rod 46*a* and this pressure develops a force across the shear pin 236 which subsequently breaks. This allows the upper housing 232 of the plug to travel downwards and he upper end 232 of the plug 226 travels past the end of the annulus bore side outlet 222, thereby rendering the annulus open, as best seen in FIGS. 33*a,b*. As the upper end 232 of the plug 226 engages with the lower plug pin 236 the detent ring 240 is lifted. The spring-loaded detent fingers 238 are released which engage in a mating groove 244 in the annulus bore 27*a*. Both bores are now fully open and the actuator rod 46*a* is locked in the fully open condition.

It will be understood that the embodiment shown in FIGS. 27 to 33 can be used instead of the embodiments described with reference to FIGS. 1 to 26 and can also be used in all of the aforementioned applications.

It will also be understood that a single actuation rod may be used in the embodiments described with reference to FIGS. 1 to 26 as for the embodiments in FIGS. 27 to 33, i.e. a single actuation rod with a T-stem or yoke to couple to the actuation bars. Also for all embodiments, two actuation bars may be disposed in parallel on each side of the ball valve element; one bar above and the other bar below the centre of rotation.

Figure 34A:
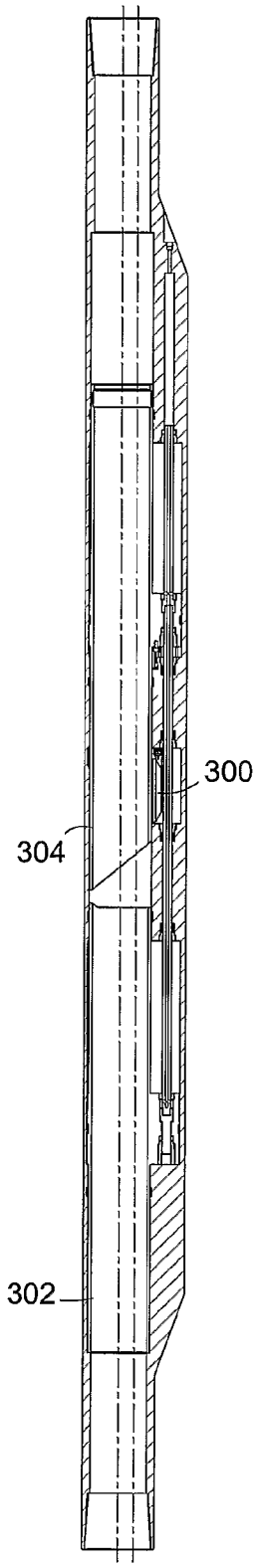
FIGS. 34*a,b,c* depict an alternative embodiment of a completion suspension valve tool in accordance with the present invention in which a flapper valve is used in place of an offset aperture ball valve.
Figure 34B:
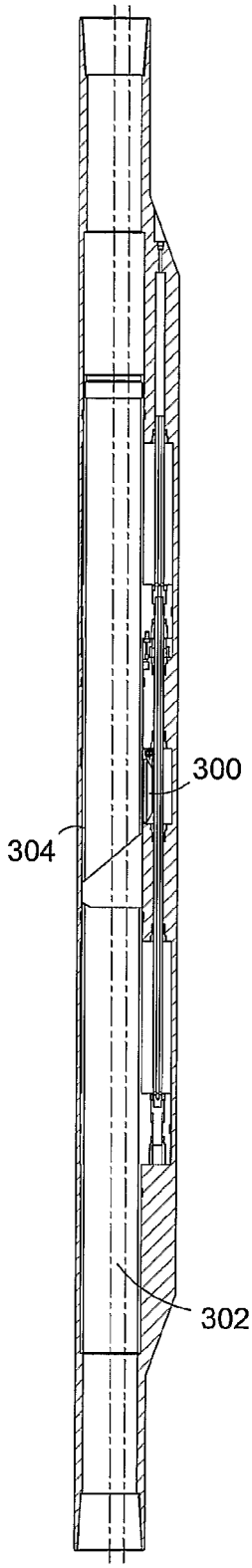
FIG. 34*b* depicting the flapper valve in a normally open position, i.e. for production and FIG. 34*c* depicting the flapper valve in the overridden, locked open position.
Figure 34C:
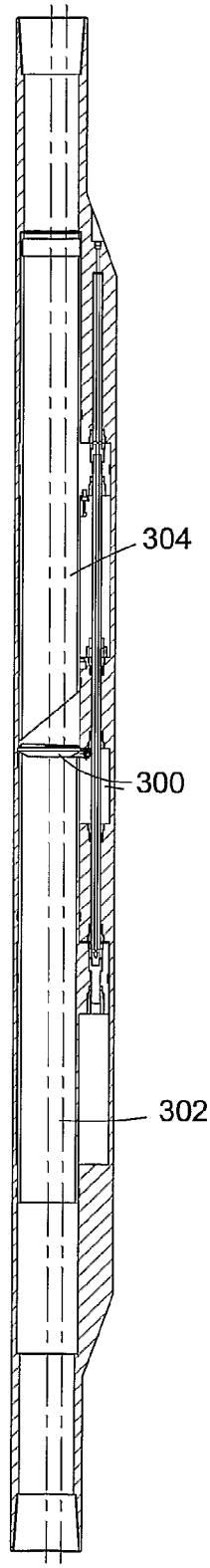

Various modifications may be made to the embodiments hereinbefore described without departing from the scope of the invention. For example, although the completion suspension valve is described with reference to use of an apertured offset ball valve element, a different type of valve structure may be used to achieve the same function. In FIGS. 34*a, b* and *c*, an alternative completion suspension valve is shown in which the valve element is provided by a hinged flapper valve 300. In FIG. 34*a*, the flapper valve is shown in the normally closed position in which the valve is biased closed to block the production bore 302. FIG. 34*b* depicts the valve in the normally open position in which an internal sleeve 304 is moved down to abut the valve and force it into the open position where it lies parallel to the valve bore. Movement of this sleeve is achieved hydraulically using hydraulic lines in a similar manner to previously described as will be understood by a person of ordinary skill in the art. In this position, the function of the valve is similar to the system with the apertured offset ball valve 64. FIG. 34*c* shows the valve open but in the overridden position and it will be seen that the valve sleeve 304 has been forced down such that it is further towards the lowermost portion of the valve housing; in this position the valve is maintained fully open for reasons set forth above. It will also be appreciated that the valve bore in this arrangement is, like the apertured ball valve, is offset, i.e. it is not centred on the valve housing.

It will be understood that flapper valves are widely used in the oil and gas industry as down hole safety valves. These valves are incorporated in the completion tubing of a producing well at a location typically 200 meters approximately below the wellhead. These valves are operated by a single hydraulic line which conveys control fluid from the lower end of the tubing hanger down through the primary annulus and into the actuator of the valve. These flapper valves are typically failsafe-closed valves and rely on a torsion spring to deliver the flapper to the closed condition. The actuator is typically imbalanced to well bore pressure. In the open condition control pressure must be maintained on the valve control line to hold an actuation sleeve in its lowermost position. In this position, the actuation sleeve displaces the flapper element, rotating it via a pivot pin to a position outside the system bore. When the well bore pressure is present, venting the control pressure allows the actuation piston to travel upwards. As the piston travels upwards the flapper valve element is encouraged to rotate by the torsion spring. Once the piston has reached its uppermost position the flapper valve element engages on to a seat whereby the bore is occluded and a seal is established. Increasing pressure from beneath the valve increases the intensity of the force and hence the integrity of the seal.

These flapper valves are designed to isolate the formation from the surface equipment. Consequently the ability of such valves to provide only differential containment from below is perfectly adequate for the intended purpose. It would, however, be advantageous if a similar valve existed for containing differential pressure from both directions. Such a valve would have many applications such as, but not limited to; landing string lubricator valves; landing string retainer valves and lightweight intervention system lubricator valves.

It is also an object of the present invention to provide a flapper valve assembly with bi-directional sealing performance and so permit the use of the flapper valve in the aforementioned applications.

The structure shown in FIGS. 35-40 achieves this and a detailed description of this flapper valve housing assembly will now be given.

Figure 35:
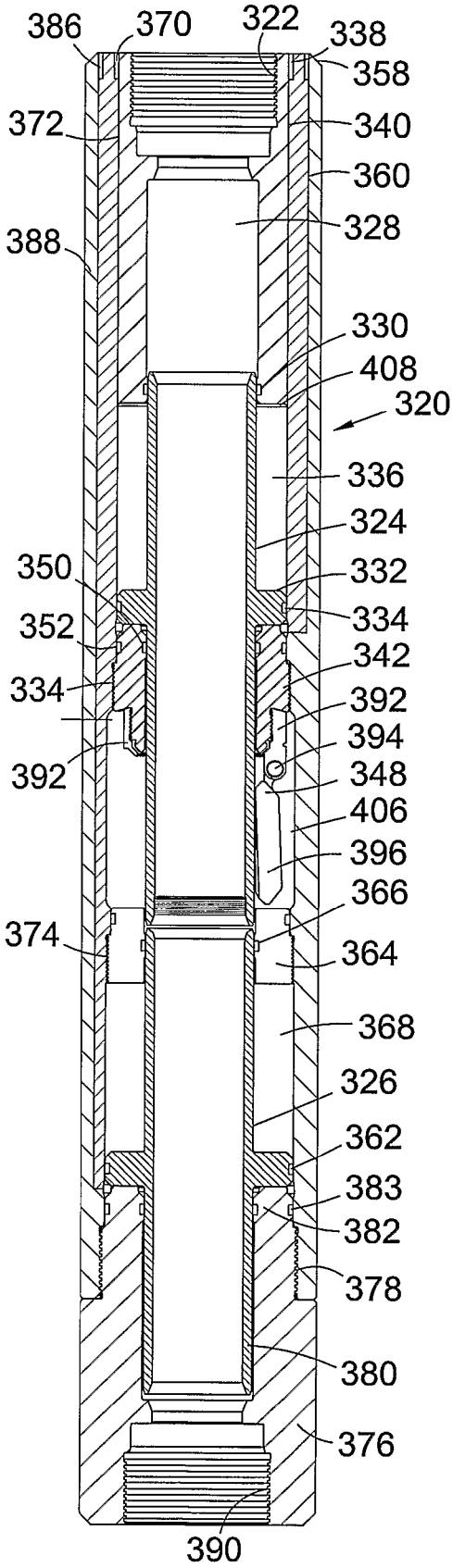
FIG. 35 is a longitudinal sectional view of an alternative flapper valve arrangement for use with the completion suspension valve tool in accordance with the present invention, with the valve in the open condition.

Reference is first made to FIG. 35 of the drawings which depicts a flapper valve housing or sub generally indicated by reference numeral 320. The housing 320 has a threaded connection 322 for connection to a tubing hanger (not shown) as described above. Disposed within the housing 320 are an upper piston 324 and a lower piston 326, the upper and lower pistons being movable within a bore 328 of the housing 320. The upper end of piston 324 is engaged with the bore 328 of the main body by a seal 330 and the middle portion of the upper piston has annular shoulders 332 which also engage with the main housing 320 via a seal 334. The diameter of seal 330 is less than the diameter of seal 334 and a hydraulic chamber generally indicated by reference numeral 336 is formed between these seals. Chamber 336 is also known as is also known as the upper piston top chamber. A hydraulic control port 338 conveys hydraulic fluid from the top of the main body 320 via a hydraulic line 340 to the hydraulic chamber 336.

In FIG. 35 there is shown an upper seal ring generally indicated by reference numeral 342 which is connected by a threaded connection 344 to the housing 320 so that the seal ring 342 is rigidly engaged to the housing. It will be seen that seal ring 344 engages with the outer diameter of the lower part 348 of the piston 324 and to the inner diameter of the main body 320, via seals 350 and 352 respectively.

Figure 36:
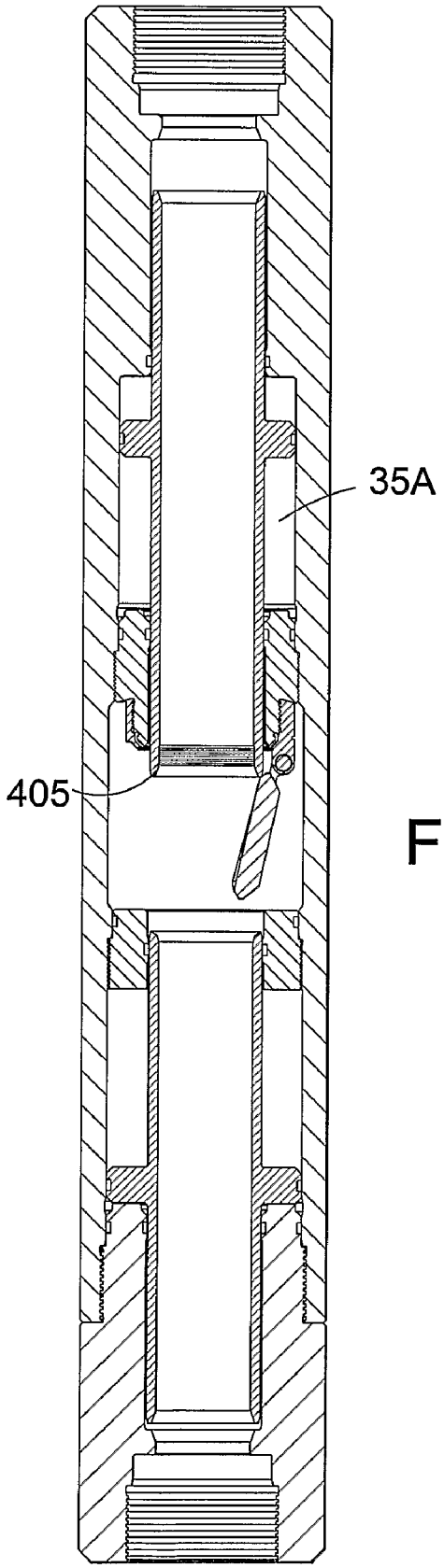
FIG. 36 is a similar view to FIG. 35 but with the flapper valve partially actuated to the closed condition.

A further hydraulic chamber is formed between the seals 334, 350 and 352, this further hydraulic chamber generally indicated by reference numeral 354 and is known as the upper piston bottom chamber. Chamber 354 is best seen in FIG. 36 when the upper piston has been moved upwardly. A hydraulic control port 358 connected via hydraulic line 360 to the upper piston bottom chamber 354.

Similarly the lower piston 326 is sealed to the main housing body 320 via seal 362. The upper part of piston 326 is sealed to a lower seal ring 364 via seal 366 which is located on the outside diameter of part of the piston 326. This also seals to the inside diameter of the main body. A hydraulic chamber 368 is formed between seals 362 and 366 and is the lower piston top chamber 368. The hydraulic control port 370 conveys hydraulic fluid from the top of the main body 320 to the lower piston top chamber 368 via hydraulic line 372. As with the upper seal ring 342 the lower seal ring 364 is threadedly engaged via connection 374 to the housing body 320 and a lower end cap 376 is coupled via threaded connection 378 to the main body 320. The lower end cap 376 seals the lower portion 380 of the piston via seals 382, 383 which are connected between the external diameter of the lower portion of piston 326 and the internal diameter of the end cap 376. A further hydraulic chamber 384 (best seen in FIG. 38) is formed between seals 362 and 382. This chamber is known as the lower piston bottom chamber 384. The hydraulic control port 386 conveys hydraulic fluid via hydraulic control line 388 to the chamber 384.

The lower end cap 376 offers a downward facing thread 390 for subsequent connection to a tubular member.

Figure 39:
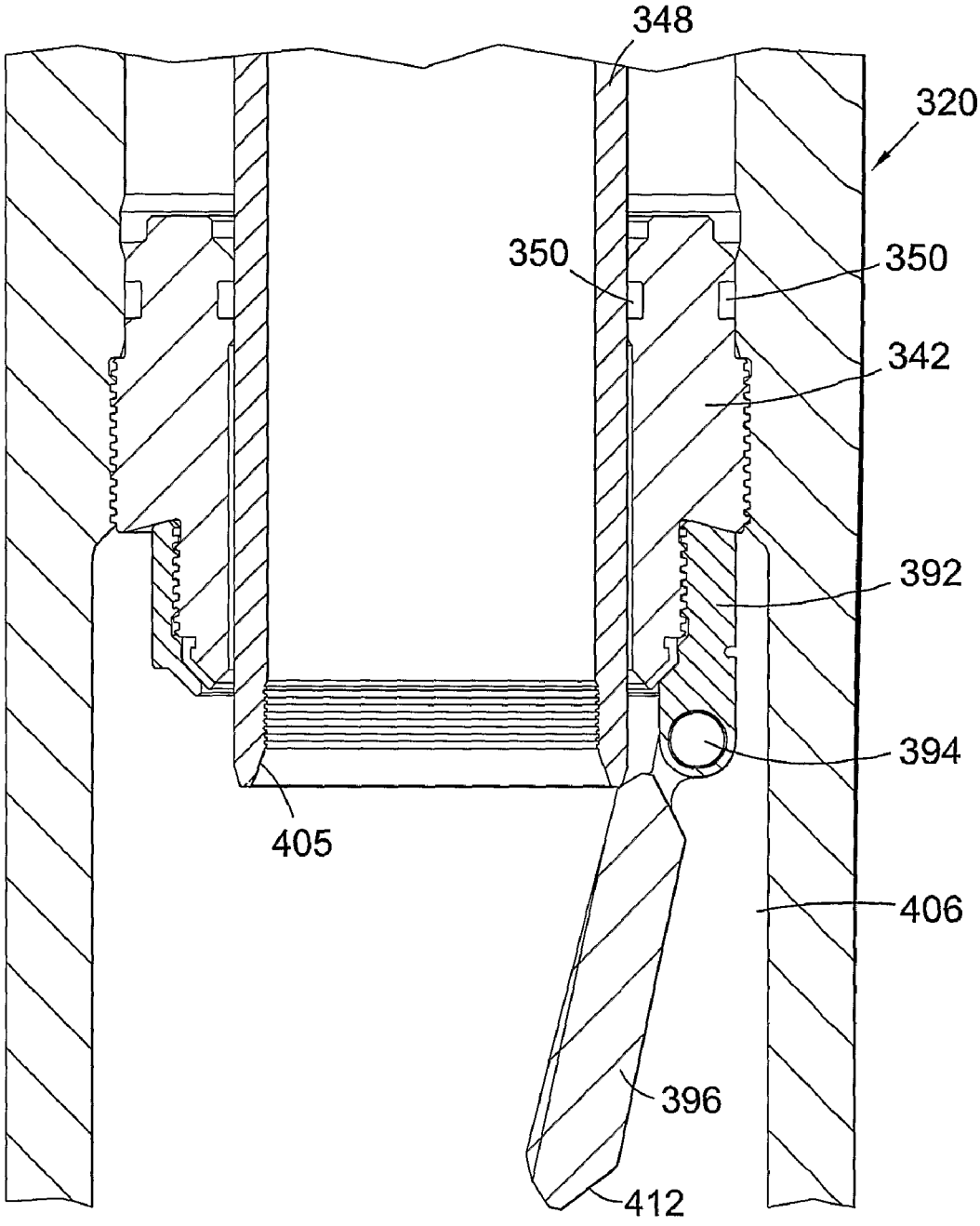
FIG. 39 is an enlarged detailed sectional view of the flapper valve element and associated components, the valve being shown in the partially closed condition.

As best seen in FIG. 39 a seat ring 392 is connected to the upper seal ring 342 by threaded connection 394 and accordingly the seat ring 392 is rigidly connected to the upper seal ring 342. Still referring to FIGS. 35 and 39 it will be seen that the seat ring engages with a pivot pin 394 on which a flapper valve element 396 is mounted.

As now described with reference to FIGS. 40*a*, 40*b*, 40*c* and 40*d* a torsion spring 398 is disposed around the pivot pin 394. The torsion spring 398 has reaction lugs 400, 402 which engage respectively with the outside of the seat ring 392 and the reaction spigot which bears on the rear side 404 of the flapper element 396. The torsion spring 398 is configured such that the coils 398*a* of the torsion spring (best seen in FIG. 40*b*) bias the flapper valve element 396 to move to the closed position shown in FIGS. 40*c* and 40*d* when the upper piston 324 is actuated upwardly.

The operational sequence of the flapper valve assembly 320 will now be described with reference to FIGS. 35-40.

Firstly with reference to FIG. 35 will be seen that this Figure depicts the flapper valve element 396 in the fully open position with both the upper and lower pistons 324, 326 being disposed in their lowermost positions. The flapper element 396 is displaced into an annular cavity 406 between the upper piston 324 and the main body housing 320 and advantageously the flapper element 396 is protected from flow in this position by the presence of the upper piston 324.

Figure 37:
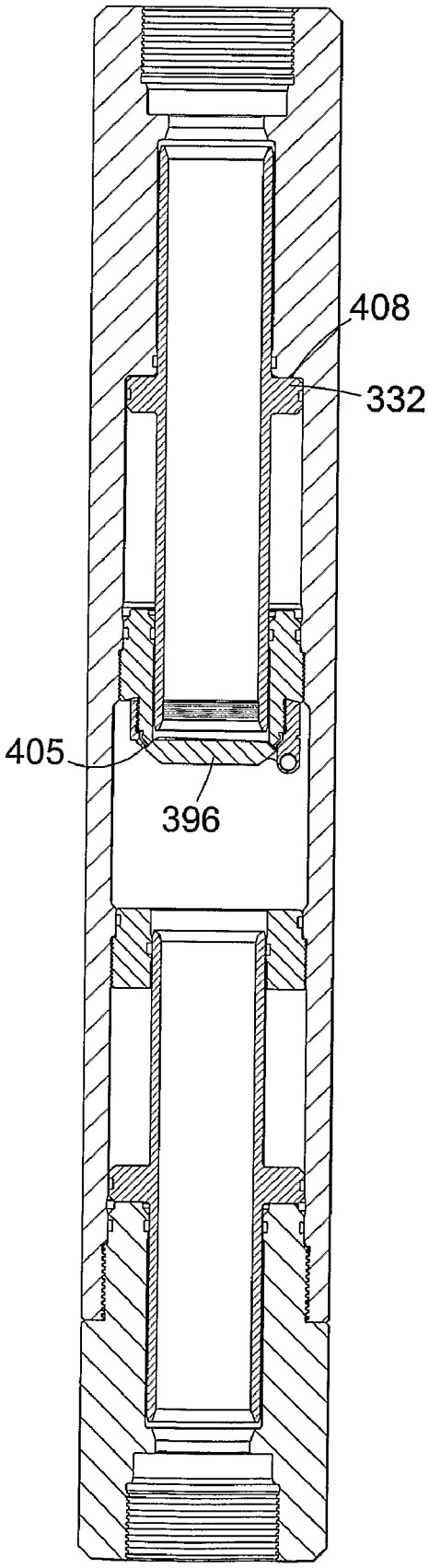
FIG. 37 is a similar sectional view of the flapper valve housing with the flapper valve in the closed condition.

The upper top piston chamber 336 is vented by operating a valve (not shown) at the control system which permits the fluid trapped in the chamber 336 to return to a tank (not shown) in the control system, via a control line, allowing hydraulic fluid in the chamber 336 to be discharged. The venting of the hydraulic chamber is achieved using control lines, a tank and a venting arrangement of a type that is well known in the art. Hydraulic pressure is then applied via line 360 to the upper piston bottom chamber 354 and as a result of this pressure differential the upper piston 326 is moved upwards to a position best seen in FIG. 36. The flapper valve element 396 which had been pushed to the outside diameter of the piston and retained in annular space 406 is now rotated about pivot 394 into the bore 328 under the action of the torsion spring 398. The rotation of the flapper valve element 396 is controlled by the position of the upper piston 324. The upward travel of the upper piston 324 continues until the shoulder 332 of the upper piston 324 abuts the shoulder 408 of the main body as best seen in FIG. 37 at which point the upper piston 324 is considered to be in its uppermost position. At this point the flapper valve element 396 has fully rotated as shown in FIG. 37 to be engaged with valve seat 405 of the seat ring 342 at which position the valve is considered to be fully closed. Hydraulic pressure into the upper piston bottom chamber 356 may now be vented in a similar manner to that described above.

In this condition the flapper valve arrangement is capable of providing differential pressure containment from below the flapper valve element 396. However it will be understood that, if a differential pressure is applied from above the flapper valve element 396, this would cause the flapper element 396 to move off the valve seat 342 and allow the pressure to pump through the bore 328.

Figure 38:
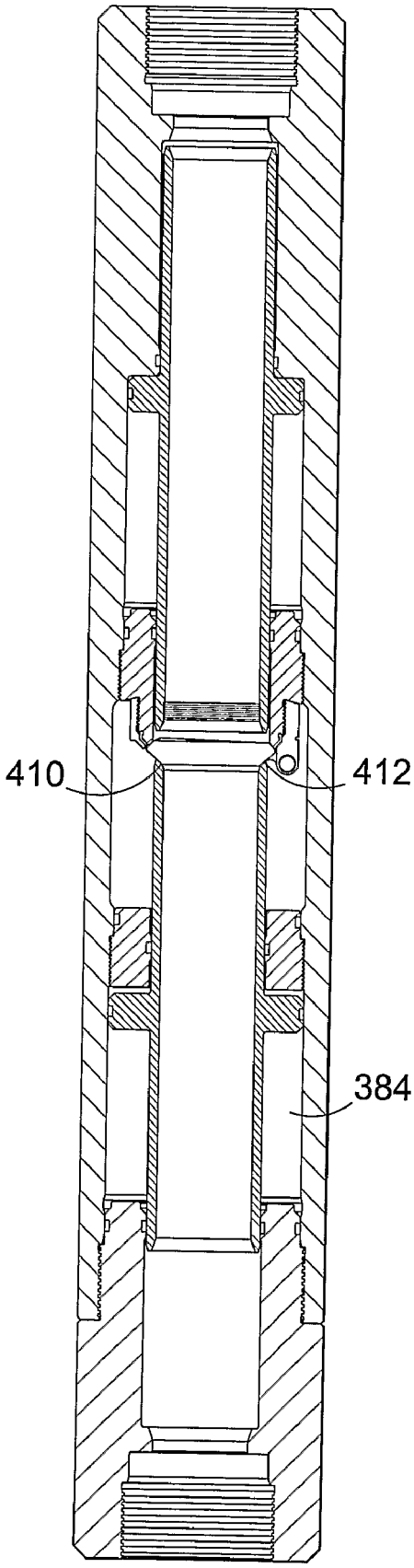
FIG. 38 is a sectional view of the flapper valve housing with the flapper valve shown in the supported condition where the valve provides differential containment from below and above the flapper valve.

The lower top piston chamber 368 is now vented in a similar manner to that described above allowing hydraulic fluid therein to be discharged. Hydraulic pressure is then applied to the lower piston bottom chamber 384 via hydraulic line 388 and as a result of the pressure differential the lower piston 326 is moved upwards as best seen in FIG. 38. The lower piston 326 travel continues until the upward facing conical face 410 at the top end of the lower piston 326 engages with a similarly shaped conical surface 412 on the underside of the flapper valve element 396. In this position the lower piston 326 effectively pushes the valve element 396 on to the valve seat 405 best seen in FIG. 38. In this condition the flapper valve element is locked and the assembly is now capable of providing differential containment both from below and above the flapper valve element 396. The magnitude of the containment from above is related to the pressure prevailing in the lower piston bottom chamber 384. In the arrangement illustrated in order to contain a given differential pressure from above then a similar pressure is required to be applied to the lower piston bottom chamber.

Opening of the flapper valve element 396 is the reverse of the previously described sequence. The lower piston 326 is first moved back to its lowermost position shown in FIG. 1 by applying hydraulic pressure via port 370 and hydraulic line 372 followed by applying hydraulic pressure to the upper hydraulic chamber 366 via port 338 and hydraulic line 340 to force the upper hydraulic piston 324 back to the position shown in FIG. 35 which in turn would displace the flapper valve element 396 back to its annular recess 406.

Figure 40A:
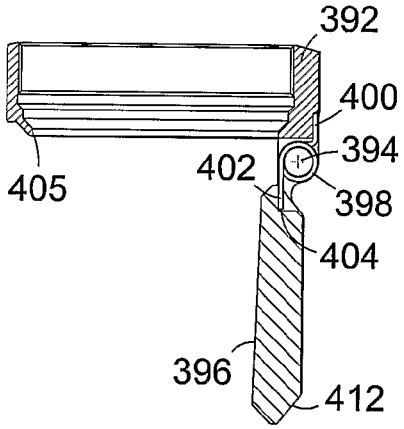
FIGS. 40*a* and 40*b* depict side enlarged sectional and bottom views of the flapper valve in the open position illustrating the coil windings of the torsion spring and the reaction lugs.
Figure 40B:
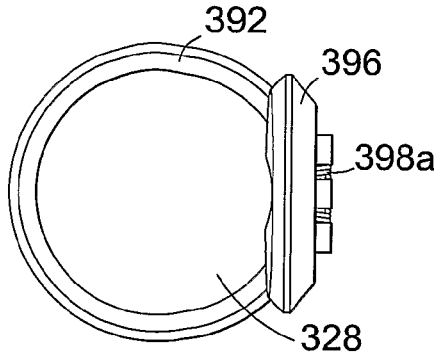
Figure 40C:
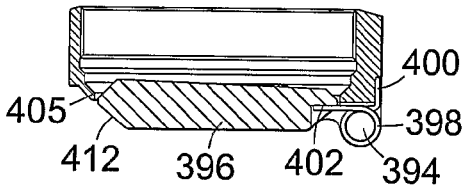
FIGS. 40*c* and 40*d* are similar to FIGS. 40*a* and 40*b* and depict the flapper valve in the closed position.
Figure 40D:
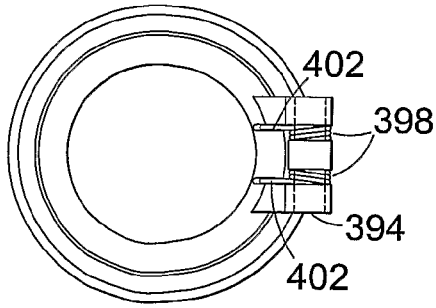

Reference is now made to FIGS. 40*a,b,c* and *d* of the drawings which depicts the torsion spring 398 disposed about the pivot 394. The torsion spring 398 has a first spring reaction lugs 400 which engages with the outside of the seat ring 392 and second reaction lugs 402 which engages with a recess 404 on the back of the flapper valve element 396, as best seen in FIGS. 40*a*, 40*c*. The torsion spring 398 is configured such that the coils 398*a* encourage the flapper valve element 396 to move to the closed position as shown in FIGS. 36, 37 and 39, 40*c* and 40*d*. As best seen in FIGS. 39 and 40*c* the upper conical surface 414 of the valve element 396 engages with the valve seat 405 of the upper seal ring 342.

It will be appreciated that the flapper valve assembly described with reference to FIGS. 35-40 may be used with the completion suspension valve system described with reference to FIG. 1-33 as an alternative to the flapper valve arrangement described in FIG. 34.

The foregoing embodiments provide a number of inventive solutions and advantages which have not been hitherto present in the art. The principal advantage is that the completion suspension valves allow the well to be desuspended without the need to establish a dual bore riser to surface. This allows non-MODU type vessels to conduct xmas tree installation operations and desuspension operations. Such vessels are readily available and are chartered for a fraction of the cost of an MODU.

It will be seen that the completion suspension valve has a variety of applications, such as an in-line tree, a subsea installation tree and a hybrid tree insert and the completion suspension valve has the advantage that the valves can be located within the restricted envelope defined by the tree bore, thus facilitating installation and removal.

The invention claimed is:

1. A completion suspension valve system comprising:

a suspension valve housing, said valve housing having a production bore;

a valve element disposed in said suspension valve housing, the valve element being an apertured ball valve element with a valve bore offset from the centre of the ball, so that one portion of the ball element is relatively thick and another portion of the valve element is relatively thin;

said valve being remotely actuatable between an open position and a closed position;

the production bore being offset from the centre of the valve housing;

actuation means coupled to the ball element for permitting remote actuation of the ball element, said actuation means comprising at least one moveable guide shaft disposed substantially parallel to the production bore, at least two actuation bars coupled between the respective guide shafts and to the apertured ball element, the actuation bars being coupled to the guide shaft by rotatable pin joints, and being slidingly located in respective bar pockets of said ball element; and wherein said valve element may be actuated to remain in the open position, and wherein said system includes ram means for moving between a first non-engaged position wherein said valve element remains normally open and a second engaged position where the valve is set in the open position.

2. A system as claimed in claim 1 wherein an offset bore valve seat is disposed in said production bore for engaging with said ball element, one side of the valve seat having a relatively thick portion and the other side of the valve seat having a relatively thin portion.

3. A system as claimed in claim 2 wherein an inclined groove is disposed in said production bore for receiving an elastomeric seal with the lowest part of the groove being disposed adjacent to the thinnest part of the valve seat to minimise the length of seat exposed to differential pressure.

4. A system as claimed in claim 1 wherein said ram means has locking mandrel means for engaging with a locking nipple and said mandrel means being actuatable by the ram means to move the locking nipple from a first unlocked position to a second locked position, such that when the nipple is in said second locked position the ball element is locked in the open position.

5. A system as claimed in claim 4 wherein the nipple is normally retained to the housing by means of a shear pin.

6. A system as claimed in claim 5 wherein the nipple has two legs, one leg being coupled to each of said guide shafts so that as said mandrel and ram move to engage and move the nipple towards said ball element, the nipple movement causes the guide shafts to rotate and move the ball element to a fully open position.

7. A system as claimed in claim 1 wherein said ball is allowed to float upwards when in said closed position to maintain a contact force between the valve seat and ball surface in proportion to the prevailing differential pressure, by providing trunnions with two arcuated portions and a rebate in each trunnion bore bearing for receiving said arcuate portion when the ball is in the closed position.

8. A subsea installation tree incorporating a suspension valve as claimed in claim 1.

9. A tubing hanger for use with a hybrid tree insert, said tubing hanger having a completion suspension valve as claimed in claim 1.

10. A system as claimed in claim 1 wherein said moveable guide shaft is coupled to a yoke having two ends and the ends of the yoke are each coupled to two actuation bars disposed in parallel on each side of the ball element above and below the centre of the ball element rotation.

11. A system as claimed in claim 1 wherein said valve element is actuated to remain in the open position, said system including an override plug dimensionable to pass through an annulus bore and for engaging with the top of said actuation means, said override plug being responsive to pressure to force said actuation means downward to a lowermost position in an actuation bore whereby in said lowermost position the ball valve element is actuated to a fully open position, said plug having locking means for engaging with said annulus bore when in said fully open position so that the annulus bore and the production bore are open.

12. A system as claimed in claim 11 wherein said override plug has an upper tubular housing, a lower plug pin coupled to the upper tubular housing by a shear pin, spring-loaded arms for locking the plug to the annulus bore when said production ball valve element is in the fully open position, and a retaining ring for retaining the spring-loaded arms when in an unlocked position, said retaining ring being releaseable by said lower plug pin when said override plug is in the locking position.

13. A system as claimed in claim 1 wherein the valve element is an apertured ball valve element with a valve bore offset from the centre of the ball, so that one portion of the ball element is relatively thick and the bore cuts through the sphere of the ball such that the sphere wall is discontinuous.

14. A system as claimed in claim 1 wherein the suspension valve housing is configured to be inserted wholly into a production bore of an undersea wellhead system.

15. A method of remotely suspending and desuspending a well comprising the steps of:

providing a dual bore tubing hanger having a production bore and an annulus bore, disposing a remotely operable valve in said production bore, the production bore being offset from the centre of the valve housing, actuating a guide shaft to move rectilinearly in the direction of the production bore, coupling slidable actuating bars between the guide shaft and an apertured ball valve element so that said valve element is rotatable as said guide shaft moves rectilinearly, actuating the valve remotely between an open and a closed position, actuating the valve to a fully locked open position, and engaging a locking nipple with a hydraulic operated mandrel and moving the nipple from a first unlocked position by severing a shear pin to a second locked position by engaging the nipple with a resiliently biased locking pin.

16. A method as claimed in claim 15 wherein said valve is actuated by translating linear movement to rotational movement.

17. A method as claimed in claim 16 wherein the transitional movement is achieved by providing actuating bars coupled between the rotatable ball element and rectilinearly moveable guide shafts, the actuating bars being rotatably coupled to the guide shafts by pin joints and being slideably moveable in pockets of the ball element.

18. A method as claimed in claim 15 wherein the method includes the steps of engaging an override plug with the top of a guide shaft, moving the guide shaft and plug together with the guide shaft bore to a position where the valve is fully open, and locking the override plug in the shaft bore to maintain the ball element in the open position and the production bore and annulus bores open.

19. A completion valve system comprising:

a valve housing, said valve housing having a production bore and an annulus bore;

a production bore valve element disposed in said valve housing and an annulus bore valve element disposed in said valve housing, the production bore valve element being an apertured ball valve element with a valve bore offset from the centre of the ball, so that one portion of the ball element is relatively thick and another portion of the valve element is relatively thin;

said valves being remotely actuatable in said housing between an open position and a closed position;

the production bore being offset from the centre of the valve housing; and actuation means coupled to the ball element for permitting remote actuation of the ball element, said means comprising at least two moveable guide shafts disposed substantially parallel to the production bore, at least two actuation bars coupled between the guide shafts and to the apertured ball element, the actuation bars being coupled to the guide shafts by rotatable pin joints, and being slidingly located in respective bar pockets of said ball element; and wherein said production bore valve element may be actuated to remain in the open position, and wherein said system includes ram means for moving, between a first non-engaged position wherein said production bore valve element remains normally open and a second engaged position where the valve is set in the open position.

20. A system as claimed in claim 19 wherein the valve system is a suspension system.

21. A completion valve system comprising:

a valve housing, said valve housing having a production bore and an annulus bore;

a production bore valve element disposed in said production bore and an annulus bore valve element disposed in said annulus bore, the production bore valve element being an apertured bail valve element with a valve bore offset from the centre of the ball, so that one portion of the ball element is relatively thick and another portion of the valve element is relatively thin, single actuator means moveable within said housing for actuating the production valve element and the annulus valve element to move between a closed and an open position, said actuator means being remotely operable to move said valves between said open and closed positions, the production bore being offset from the centre of the valve housing; and actuation means coupled to the ball element for permitting remote actuation of the ball element, said means comprising at least two moveable guide shafts disposed substantially parallel to the production bore, at least two actuation bars coupled between the guide shafts and to the apertured ball element, the actuation bars being coupled to the guide shafts by rotatable pin joints, and being slidingly located in respective bar pockets of said ball element; and wherein said production bore valve element may be actuated to remain in the open position, and wherein said system includes ram means for moving between a first non-engaged position wherein said valve element remains normally open and a second engaged position where the valve is set in the open position.

22. A system as claim in claimed 21 wherein said valve system is a suspension valve system.

* * * * *